US008651397B2

(12) United States Patent
Gaddis et al.

(10) Patent No.: US 8,651,397 B2
(45) Date of Patent: Feb. 18, 2014

(54) PAINT SPRAYER

(75) Inventors: Benjamin A. Gaddis, Clemson, SC (US); William E. Kaiser, Anderson, SC (US); Hans E. Nutz, Easley, SC (US); Todd Zimmerman, Simpsonville, SC (US); William B. M. Tew, Woodbridge, VA (US)

(73) Assignee: Techtronic Power Tools Technology Limited, Tortola (VG)

( * ) Notice: Subject to any disclaimer, the term of this patent is extended or adjusted under 35 U.S.C. 154(b) by 820 days.

(21) Appl. No.: 12/718,094

(22) Filed: Mar. 5, 2010

(65) Prior Publication Data

US 2010/0224699 A1 Sep. 9, 2010

Related U.S. Application Data

(60) Provisional application No. 61/158,594, filed on Mar. 9, 2009.

(51) Int. Cl.
*A62C 15/00* (2006.01)

(52) U.S. Cl.
USPC ..... 239/154; 239/146

(58) Field of Classification Search
USPC ..... 239/145, 146, 311, 407, 154
See application file for complete search history.

(56) References Cited

U.S. PATENT DOCUMENTS

| | | | | |
|---|---|---|---|---|
| 2,399,081 | A | | 4/1946 | Vose |
| 2,528,927 | A | | 11/1950 | Vose |
| 2,549,207 | A | | 4/1951 | Kestenbaum |
| 2,675,620 | A | * | 4/1954 | Whitcomb, Jr. ..... 33/722 |
| 3,327,949 | A | | 6/1967 | Eull |
| 3,482,595 | A | | 12/1969 | Coulter |
| 3,633,828 | A | | 1/1972 | Larson et al. |
| 3,796,376 | A | | 3/1974 | Farnsteiner |
| 3,814,293 | A | | 6/1974 | Daves |
| 3,816,028 | A | | 6/1974 | Schouteeten et al. |
| 3,843,052 | A | | 10/1974 | Cowan |
| 3,869,089 | A | | 3/1975 | Karasa et al. |
| 3,876,150 | A | | 4/1975 | Dwyer, Jr. et al. |
| 3,892,359 | A | | 7/1975 | Dwyer, Jr. et al. |
| 3,893,627 | A | | 7/1975 | Siczek et al. |
| 3,917,168 | A | * | 11/1975 | Tenney ..... 239/13 |
| 3,926,376 | A | | 12/1975 | Siczek |
| 3,940,065 | A | * | 2/1976 | Ware et al. ..... 239/146 |
| 3,957,209 | A | * | 5/1976 | Thomson ..... 239/429 |
| 4,000,856 | A | | 1/1977 | Quarve et al. |
| 4,003,503 | A | | 1/1977 | Aldridge |

(Continued)

FOREIGN PATENT DOCUMENTS

| | | | |
|---|---|---|---|
| GB | 1597152 | A | 9/1981 |
| WO | 2002007898 | A1 | 1/2002 |
| WO | 2007146884 | A2 | 12/2007 |

OTHER PUBLICATIONS

Graco, Inc., RTX 1500 Product Brochure, printed from Web Site www.graco.com on Mar. 3, 2009, 2 pages.

*Primary Examiner* — Davis Hwu
(74) *Attorney, Agent, or Firm* — Michael Best & Friedrich LLP

(57) ABSTRACT

A paint sprayer includes a frame, a motor supported by the frame, a pump operably coupled to the motor to draw paint from a paint source and pressurize the paint, and a blower supported by the frame and operable to discharge pressurized air into the pressurized paint discharged by the pump.

30 Claims, 29 Drawing Sheets

(56) References Cited

U.S. PATENT DOCUMENTS

| | | | | |
|---|---|---|---|---|
| 4,157,163 | A | 6/1979 | Pinto et al. | |
| 4,185,775 | A | 1/1980 | Hester | |
| 4,225,087 | A | 9/1980 | Lawlor | |
| 4,252,094 | A | 2/1981 | Draxler | |
| 4,272,019 | A | 6/1981 | Halaby, Jr. | |
| 4,294,408 | A | 10/1981 | Snyder et al. | |
| 4,393,928 | A | 7/1983 | Warnock, Sr. | |
| 4,394,938 | A | 7/1983 | Frassanito | |
| 4,416,588 | A | 11/1983 | Karliner | |
| 4,426,039 | A | 1/1984 | Kwok | |
| 4,515,294 | A | 5/1985 | Udall | |
| 4,515,334 | A | 5/1985 | Horne | |
| 4,669,952 | A | 6/1987 | Forsyth, III et al. | |
| 4,684,835 | A | 8/1987 | Kline, Jr. et al. | |
| 4,722,372 | A | 2/1988 | Hoffman et al. | |
| 4,790,679 | A | 12/1988 | Murphy | |
| 4,982,899 | A | 1/1991 | Kille et al. | |
| 4,998,696 | A | 3/1991 | Desjardins | |
| 5,050,804 | A | 9/1991 | Svendsen et al. | |
| 5,064,123 | A * | 11/1991 | Aiello et al. | 239/706 |
| 5,078,322 | A | 1/1992 | Torntore | |
| 5,078,323 | A | 1/1992 | Frank | |
| 5,084,964 | A | 2/1992 | Cyphers | |
| 5,129,423 | A * | 7/1992 | Fournier et al. | 137/614.05 |
| 5,139,357 | A | 8/1992 | Reents | |
| 5,141,161 | A | 8/1992 | Anderson et al. | |
| 5,141,162 | A | 8/1992 | Gunderson et al. | |
| D331,095 | S | 11/1992 | Steinberg | |
| 5,181,832 | A | 1/1993 | Reents | |
| 5,183,075 | A | 2/1993 | Stein | |
| 5,183,207 | A | 2/1993 | Steinberg et al. | |
| 5,213,480 | A | 5/1993 | Yedinak et al. | |
| 5,217,168 | A | 6/1993 | Svendsen | |
| 5,217,193 | A | 6/1993 | Drucker | |
| 5,217,238 | A | 6/1993 | Cyphers et al. | |
| 5,228,622 | A | 7/1993 | Murphy et al. | |
| 5,234,592 | A | 8/1993 | Schneider | |
| 5,238,146 | A | 8/1993 | Thorne, Jr. | |
| 5,242,189 | A * | 9/1993 | Osaki | 280/645 |
| 5,252,210 | A | 10/1993 | Kessel | |
| 5,281,782 | A | 1/1994 | Conatser | |
| 5,282,722 | A | 2/1994 | Beatty | |
| 5,285,965 | A | 2/1994 | McCutcheon et al. | |
| 5,286,045 | A | 2/1994 | Cyphers et al. | |
| D344,832 | S | 3/1994 | Cyphers et al. | |
| 5,320,280 | A | 6/1994 | Murphy et al. | |
| 5,322,221 | A | 6/1994 | Anderson | |
| 5,346,134 | A | 9/1994 | Ma et al. | |
| 5,346,370 | A | 9/1994 | Krohn | |
| 5,370,314 | A | 12/1994 | Gebauer et al. | |
| 5,395,051 | A | 3/1995 | Anderson et al. | |
| 5,441,297 | A | 8/1995 | Krohn et al. | |
| 5,482,378 | A | 1/1996 | Vona, Jr. et al. | |
| 5,494,199 | A | 2/1996 | Anderson et al. | |
| 5,497,945 | A | 3/1996 | Steinberg et al. | |
| 5,501,372 | A | 3/1996 | Daansen | |
| 5,505,381 | A | 4/1996 | Torntore | |
| 5,550,336 | A | 8/1996 | Kieffer | |
| 5,556,255 | A | 9/1996 | Kieffer | |
| 5,558,492 | A | 9/1996 | Kieffer | |
| 5,573,371 | A | 11/1996 | Kieffer | |
| 5,622,480 | A | 4/1997 | Walsh | |
| 5,636,794 | A | 6/1997 | Hess et al. | |
| 5,638,991 | A | 6/1997 | Todden et al. | |
| 5,655,714 | A | 8/1997 | Kieffer et al. | |
| 5,667,144 | A | 9/1997 | Snetting | |
| 5,702,131 | A | 12/1997 | Kieffer | |
| 5,736,805 | A | 4/1998 | Hyatt, Jr. et al. | |
| 5,765,753 | A | 6/1998 | Kieffer | |
| 5,769,321 | A | 6/1998 | Cyphers | |
| 5,772,711 | A | 6/1998 | Kieffer | |
| 5,782,142 | A | 7/1998 | Abend et al. | |
| 5,853,154 | A | 12/1998 | Ashley | |
| 5,887,793 | A | 3/1999 | Kieffer | |
| 5,915,592 | A | 6/1999 | Mehus et al. | |
| 6,019,293 | A | 2/2000 | Sweazy et al. | |
| 6,019,294 | A | 2/2000 | Anderson et al. | |
| 6,031,352 | A | 2/2000 | Carlson | |
| 6,062,494 | A | 5/2000 | Mills | |
| 6,244,295 | B1 | 6/2001 | Bartussek et al. | |
| 6,286,732 | B1 | 9/2001 | Daansen | |
| 6,386,393 | B1 | 5/2002 | Paulovich et al. | |
| 6,419,165 | B1 | 7/2002 | Schroeder | |
| 6,419,456 | B1 | 7/2002 | Cooper et al. | |
| D461,226 | S | 8/2002 | Hunter | |
| 6,435,846 | B1 | 8/2002 | Cooper et al. | |
| 6,520,190 | B2 | 2/2003 | Thompson et al. | |
| 6,533,488 | B2 | 3/2003 | Blenkush et al. | |
| 6,695,228 | B2 | 2/2004 | Odessa | |
| 6,708,900 | B1 | 3/2004 | Zhu et al. | |
| 6,752,067 | B1 | 6/2004 | Davidson et al. | |
| D495,400 | S | 8/2004 | Hopper | |
| 6,786,232 | B2 | 9/2004 | Schuller et al. | |
| D503,213 | S | 3/2005 | Stevens et al. | |
| D503,214 | S | 3/2005 | Stevens et al. | |
| 6,860,727 | B2 | 3/2005 | Huang | |
| 6,933,634 | B2 | 8/2005 | Frank et al. | |
| 6,953,155 | B2 | 10/2005 | Joseph et al. | |
| 7,240,909 | B2 | 7/2007 | Robens | |
| 7,244,464 | B2 | 7/2007 | Robens et al. | |
| D553,325 | S | 10/2007 | Miller et al. | |
| 7,275,662 | B1 | 10/2007 | Milcetich | |
| D558,948 | S | 1/2008 | Miller et al. | |
| 7,360,720 | B2 | 4/2008 | Gohring et al. | |
| D570,069 | S | 5/2008 | Leonard | |
| 7,458,601 | B2 * | 12/2008 | Miller et al. | 280/651 |
| 8,118,318 | B1 * | 2/2012 | Chauza | 280/47.26 |
| 2002/0028103 | A1 | 3/2002 | Frank et al. | |
| 2002/0148907 | A1 * | 10/2002 | You | 239/146 |
| 2004/0217205 | A1 | 11/2004 | Kohs et al. | |
| 2005/0254879 | A1 | 11/2005 | Gundersen et al. | |
| 2006/0040044 | A1 | 2/2006 | Robens et al. | |
| 2006/0102745 | A1 | 5/2006 | Dexter | |
| 2006/0174968 | A1 * | 8/2006 | De Luna | 141/114 |
| 2006/0177317 | A1 | 8/2006 | Thompson et al. | |
| 2007/0025863 | A1 | 2/2007 | Liedtke et al. | |
| 2007/0134050 | A1 | 6/2007 | Bruggeman et al. | |
| 2007/0228697 | A1 | 10/2007 | Miller et al. | |
| 2007/0252019 | A1 | 11/2007 | Peterson et al. | |
| 2007/0261913 | A1 | 11/2007 | Rossner et al. | |
| 2007/0278787 | A1 | 12/2007 | Jones et al. | |
| 2008/0106052 | A1 | 5/2008 | Feitel | |
| 2008/0272150 | A1 | 11/2008 | Hahn et al. | |

* cited by examiner

PAINT SPRAYER

CROSS-REFERENCE TO RELATED APPLICATIONS

This application claims priority to U.S. Provisional Patent Application No. 61/158,594 filed on Mar. 9, 2009, the entire contents of which is incorporated herein by reference.

FIELD OF THE INVENTION

The present invention relates to power tools, and more particularly to paint sprayers.

BACKGROUND OF THE INVENTION

Airless paint sprayers include a pump driven by an electric motor for pressurizing paint for subsequent discharge through a spray gun. Airless paint sprayers also include a pressure regulator for regulating the flow or pressure of the discharged paint from the pump. Therefore, a user of the paint sprayer may adjust the pressure regulator to vary the amount of paint that is discharged from the spray gun by increasing or decreasing the regulated pressure of the discharged pressurized paint. Spray guns used with airless paint sprayers include a nozzle or orifice to facilitate atomization of the paint as it is discharged from the spray gun to yield a smooth coating on a surface or workpiece.

SUMMARY OF THE INVENTION

The invention provides, in one aspect, a paint sprayer including a frame, a motor supported by the frame, a pump operably coupled to the motor to draw paint from a paint source and pressurize the paint, and a blower supported by the frame and operable to discharge pressurized air into the pressurized paint discharged by the pump.

The invention provides, in another aspect, a paint sprayer including a frame, a motor supported by the frame, a pump operably coupled to the motor to draw paint from a paint-carrying container and pressurize the paint, and a platform coupled to the frame. The platform includes a first support surface and a second support surface inclined at an oblique angle with respect to the first support surface. The paint-carrying container is supportable on one of the first support surface and the second support surface.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 19:
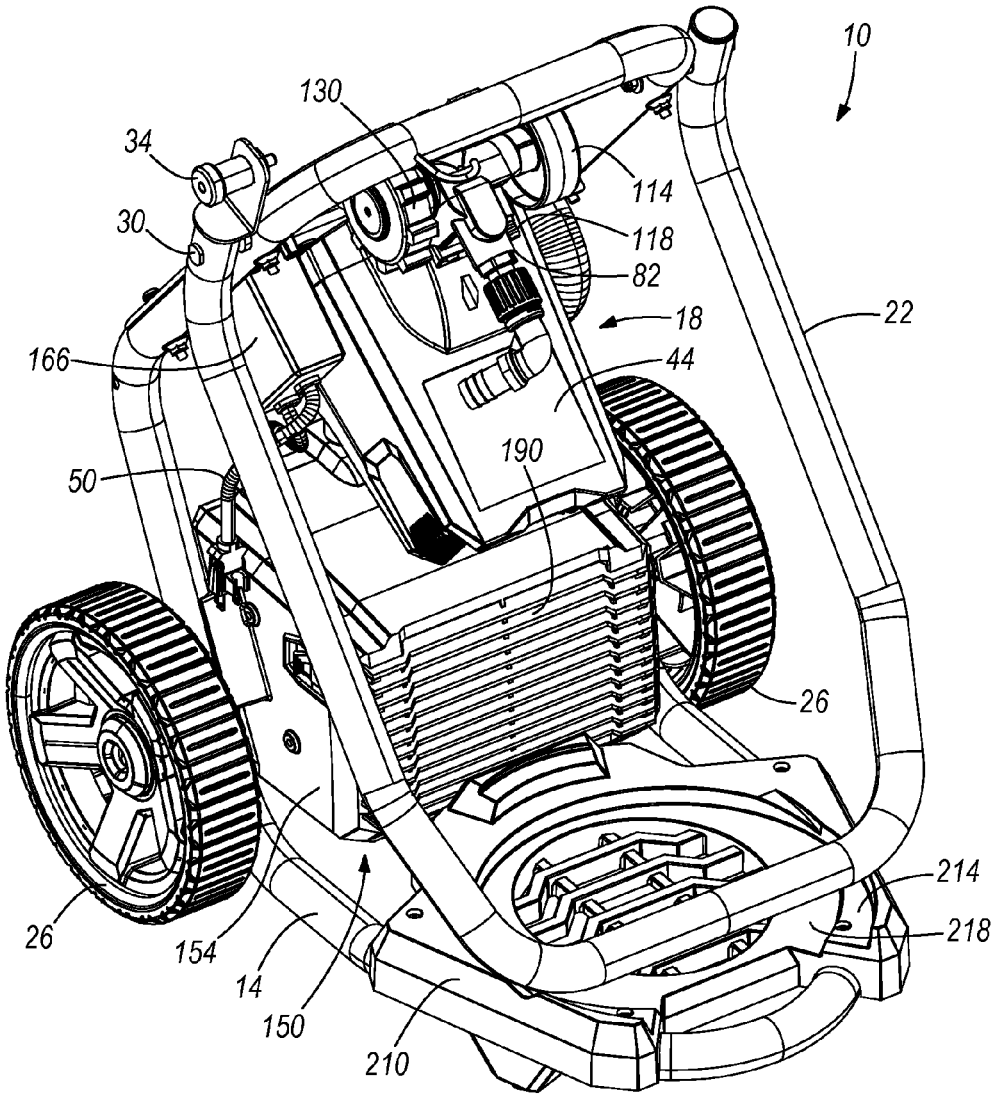
FIG. 19 is a rear perspective view of the paint sprayer of FIG. 8, illustrating a handle of the paint sprayer folded to a storage position.

With reference to FIGS. 1-7 and 8-9, a paint sprayer 10 according to one embodiment of the invention includes a frame 14 and a pump/motor assembly 18 supported by the frame 14. In the illustrated construction of the paint sprayer 10, the frame 14 is made from round tubing. Alternatively, the frame 14 may be made with differently shaped structure (e.g., square tubing, solid bar stock, L-shaped stock, etc.). Also, in the illustrated construction of the paint sprayer 10, a handle 22 and a plurality of wheels 26 are coupled to the frame 14 to facilitate transport of the paint sprayer 10. The handle 22 is pivotably coupled to the frame 14 using a plurality of fasteners (e.g., bolts 30 and a quick-release coupling 34), and is pivotable between an extended position (FIGS. 8 and 9) and a retracted position for storage (FIG. 19). To move the handle 22 to the storage position, a user of the paint sprayer 10 would pull the quick-release coupling 34 and pivot the handle 22 to the storage position. Alternatively, the handle 22 and/or wheels 26 on the paint sprayer 10 may be omitted.

Figure 1:
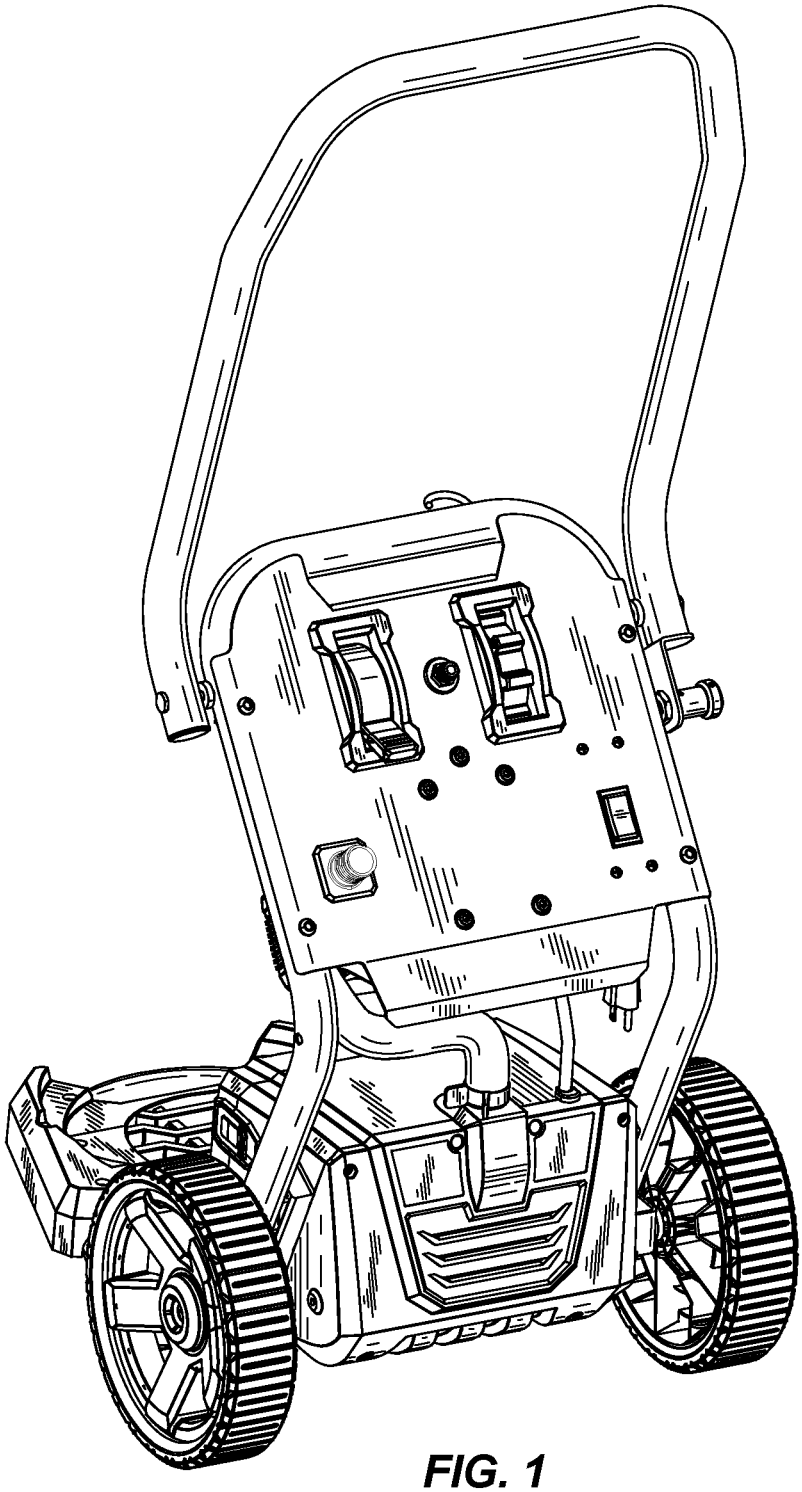
FIG. 1 is a front perspective view of a paint sprayer according to one embodiment of the invention.
Figure 2:
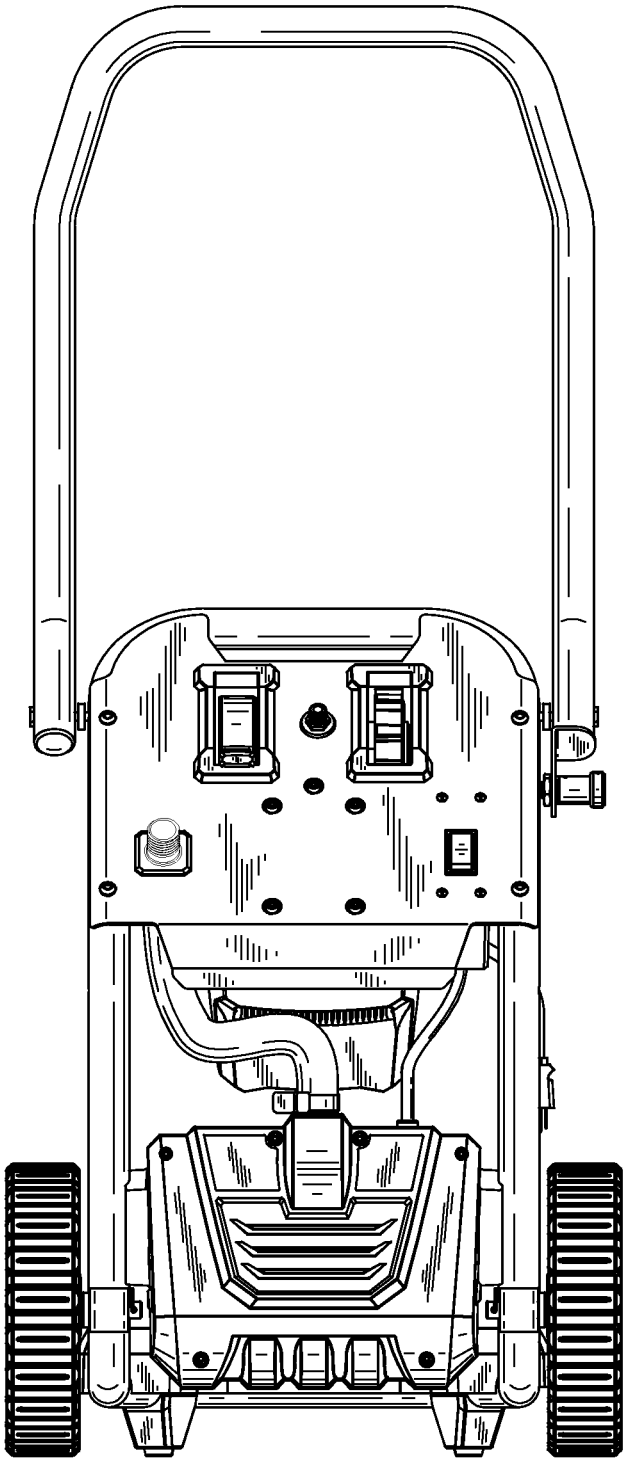
FIG. 2 is a front view of the paint sprayer of FIG. 1.
Figure 3:
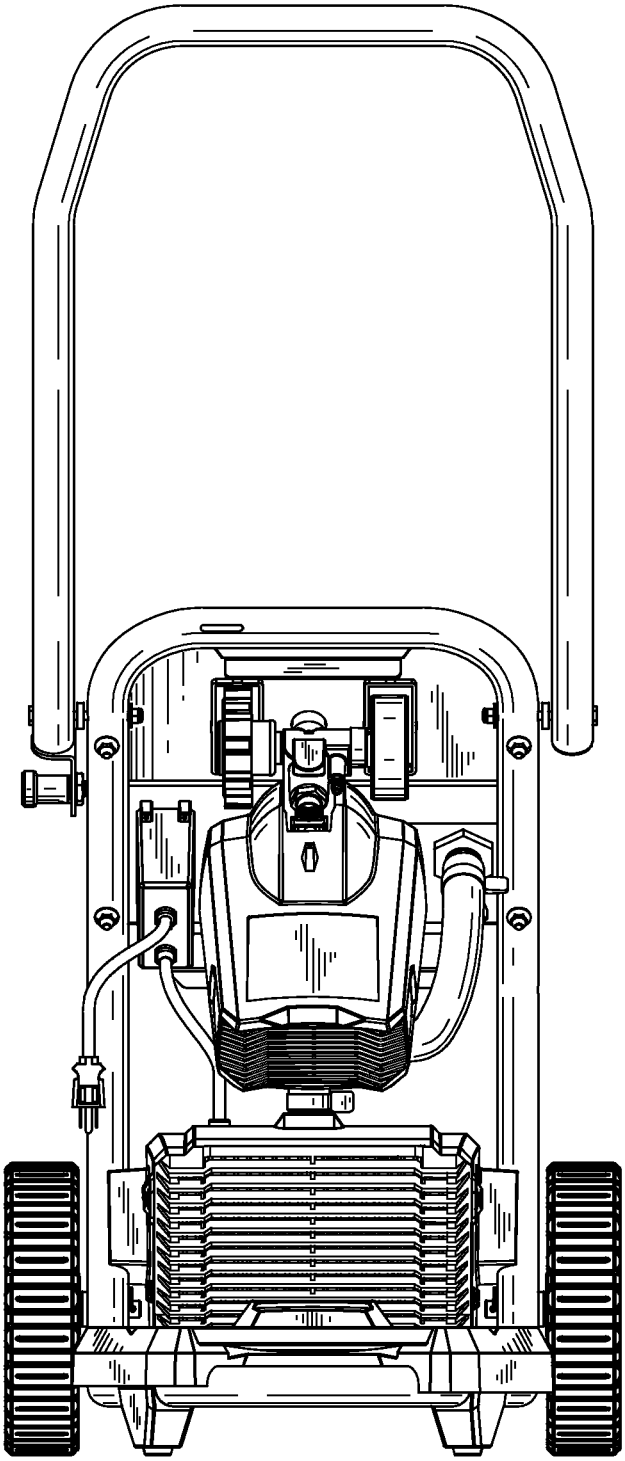
FIG. 3 is a rear view of the paint sprayer of FIG. 1.
Figure 4:
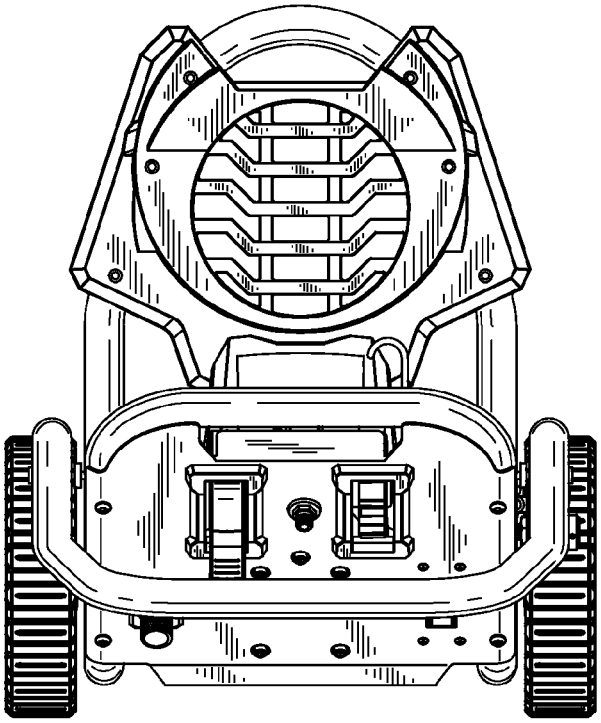
FIG. 4 is a top view of the paint sprayer of FIG. 1.
Figure 5:
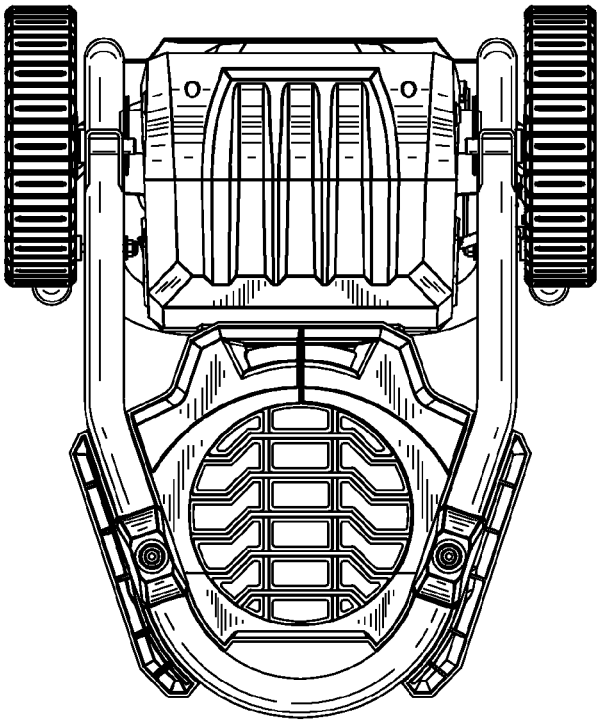
FIG. 5 is a bottom view of the paint sprayer of FIG. 1.
Figure 6:
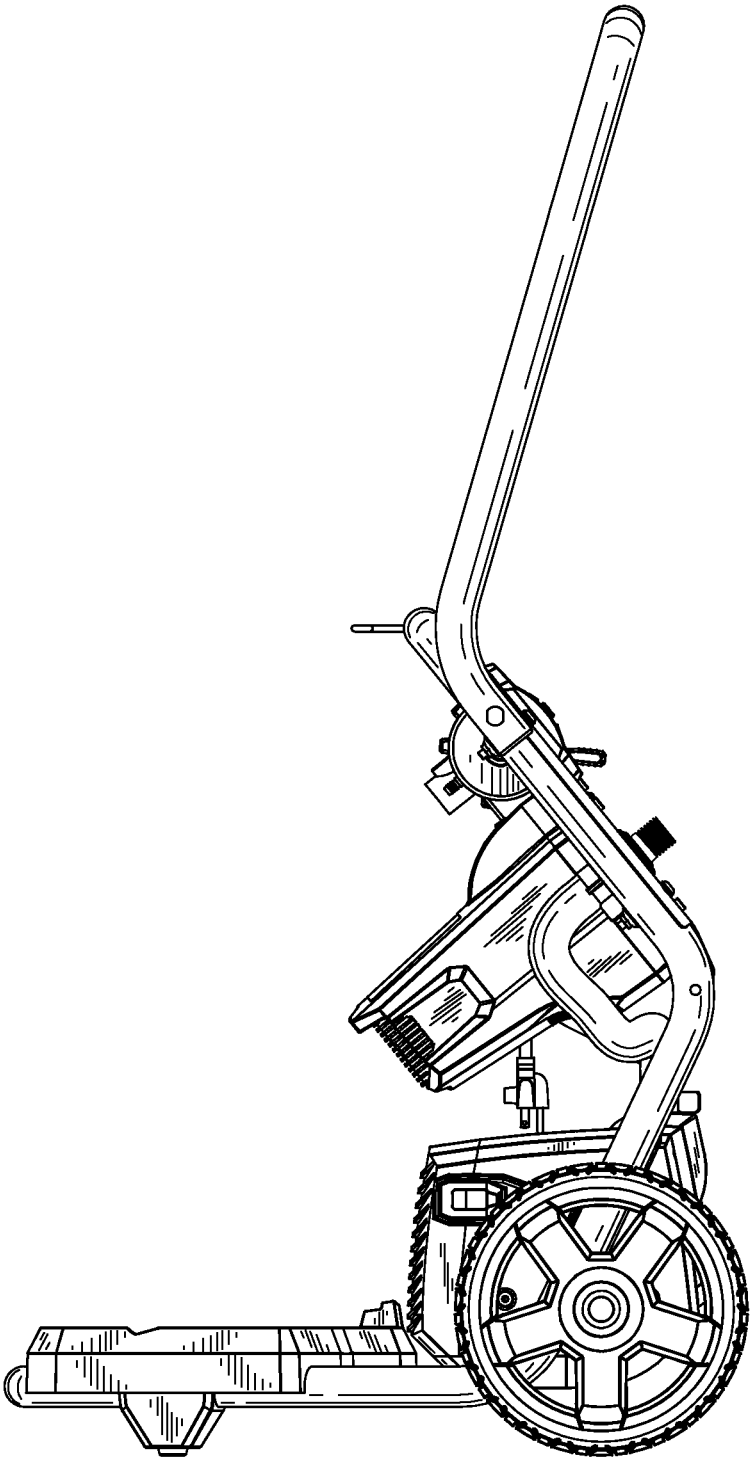
FIG. 6 is a left side view of the paint sprayer of FIG. 1.
Figure 7:
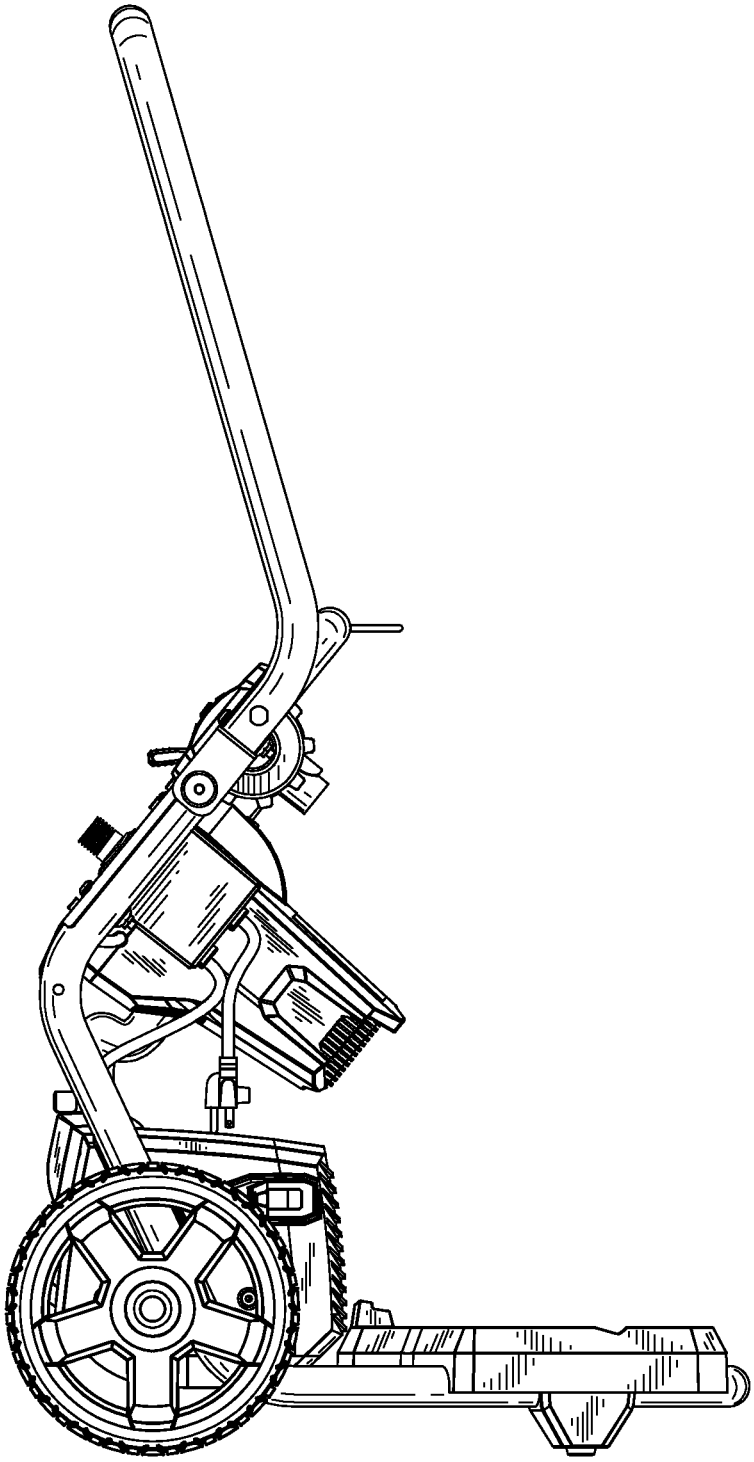
FIG. 7 is a right side view of the paint sprayer of FIG. 1.
Figure 8:
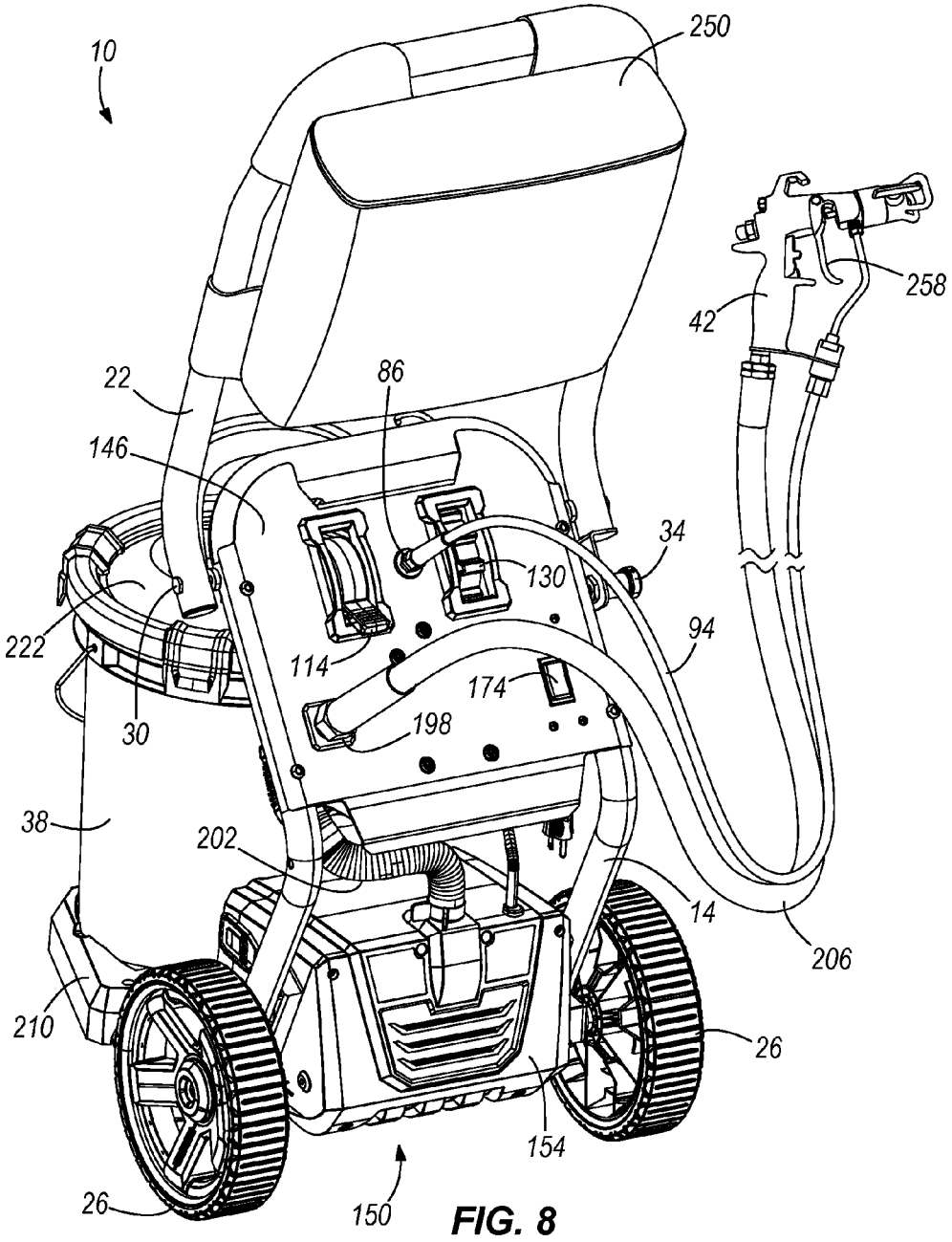
FIG. 8 is a front perspective view of the paint sprayer of FIG. 1, illustrating a spray gun coupled to the paint sprayer by a high-pressure paint hose and a low-pressure air hose.
Figure 9:
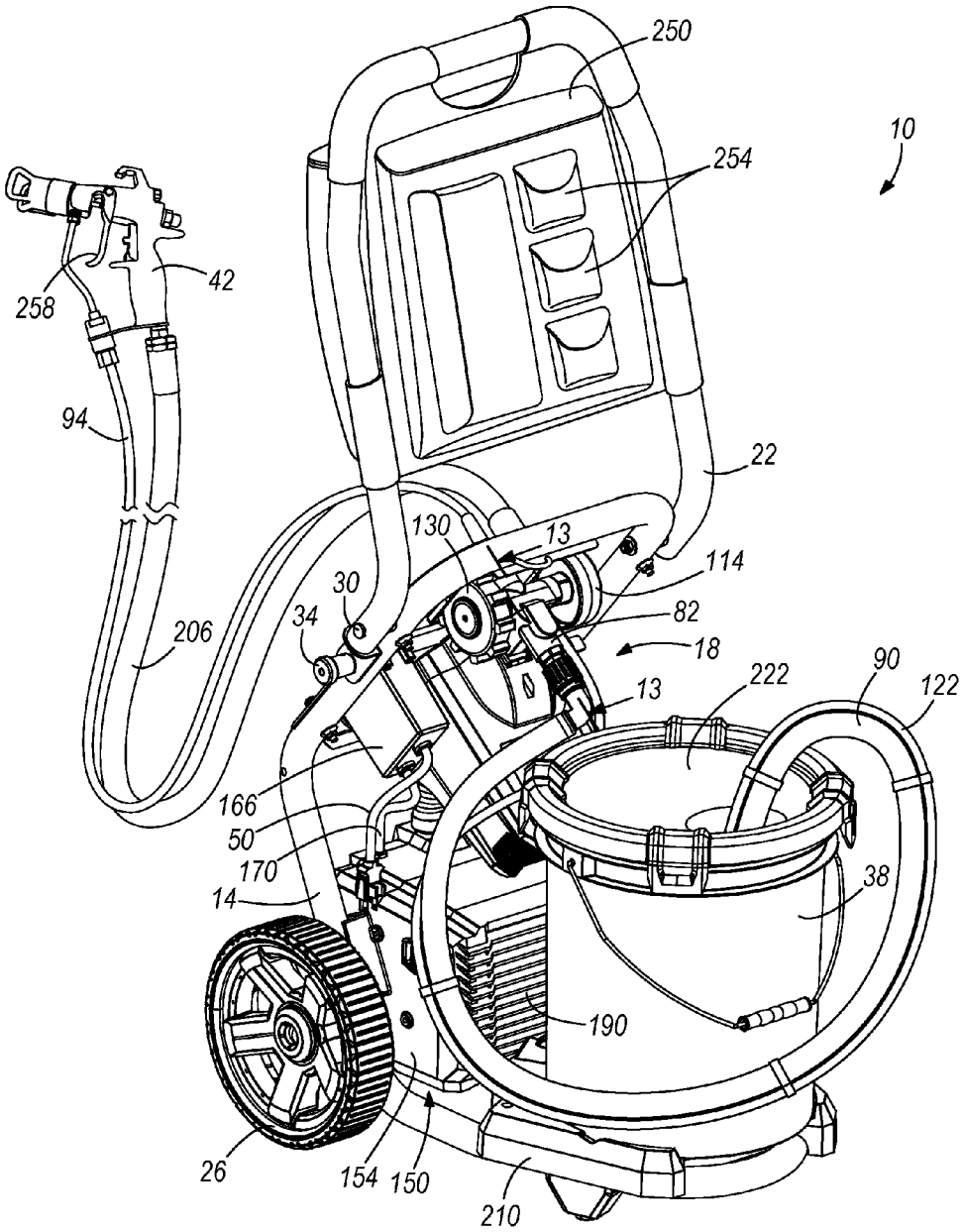
FIG. 9 is a rear perspective view of the paint sprayer of FIG. 8.
Figure 10A:
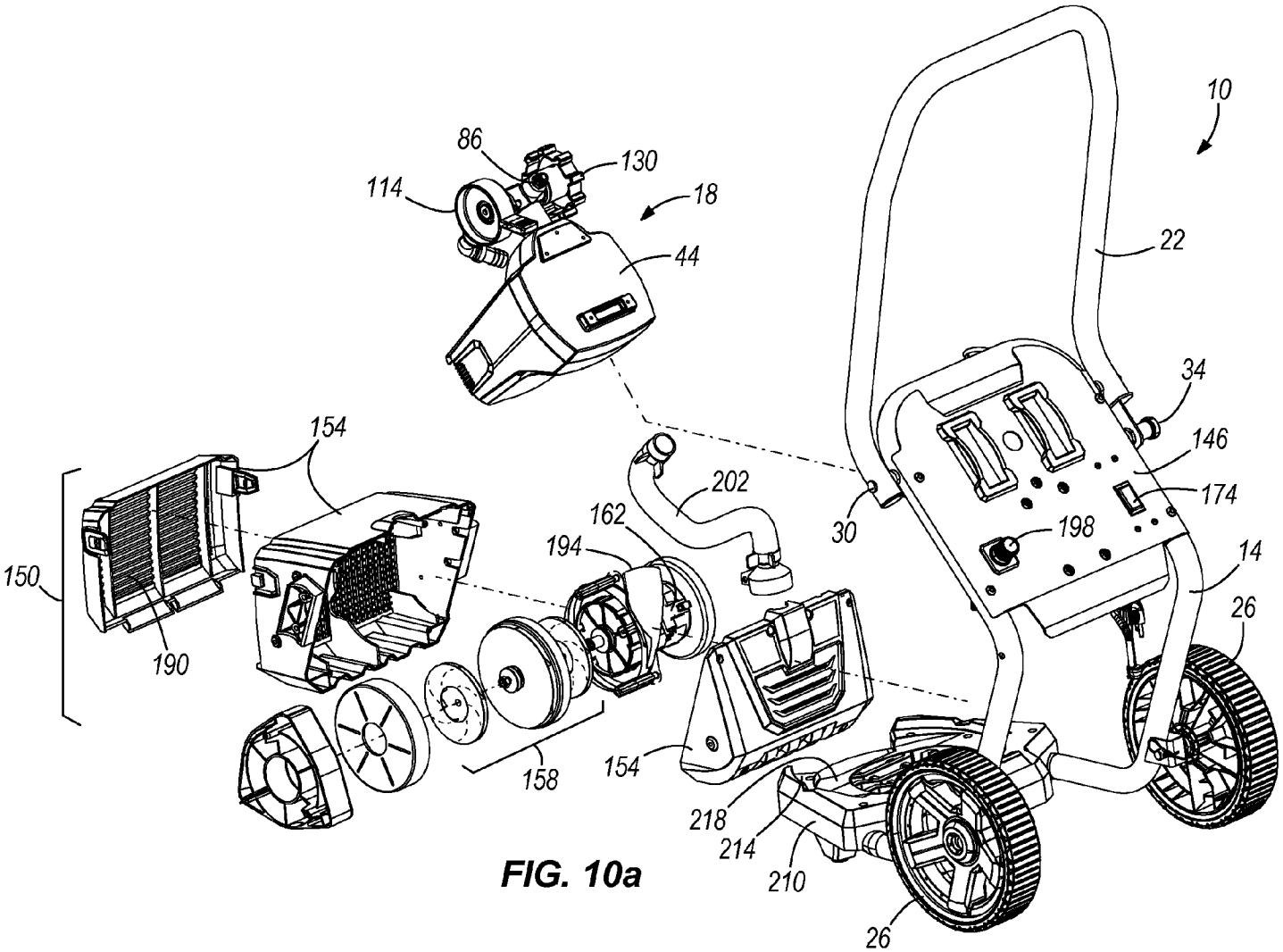
FIG. 10*a* is an exploded, front perspective view of the paint sprayer of FIG. 8.
Figure 10B:
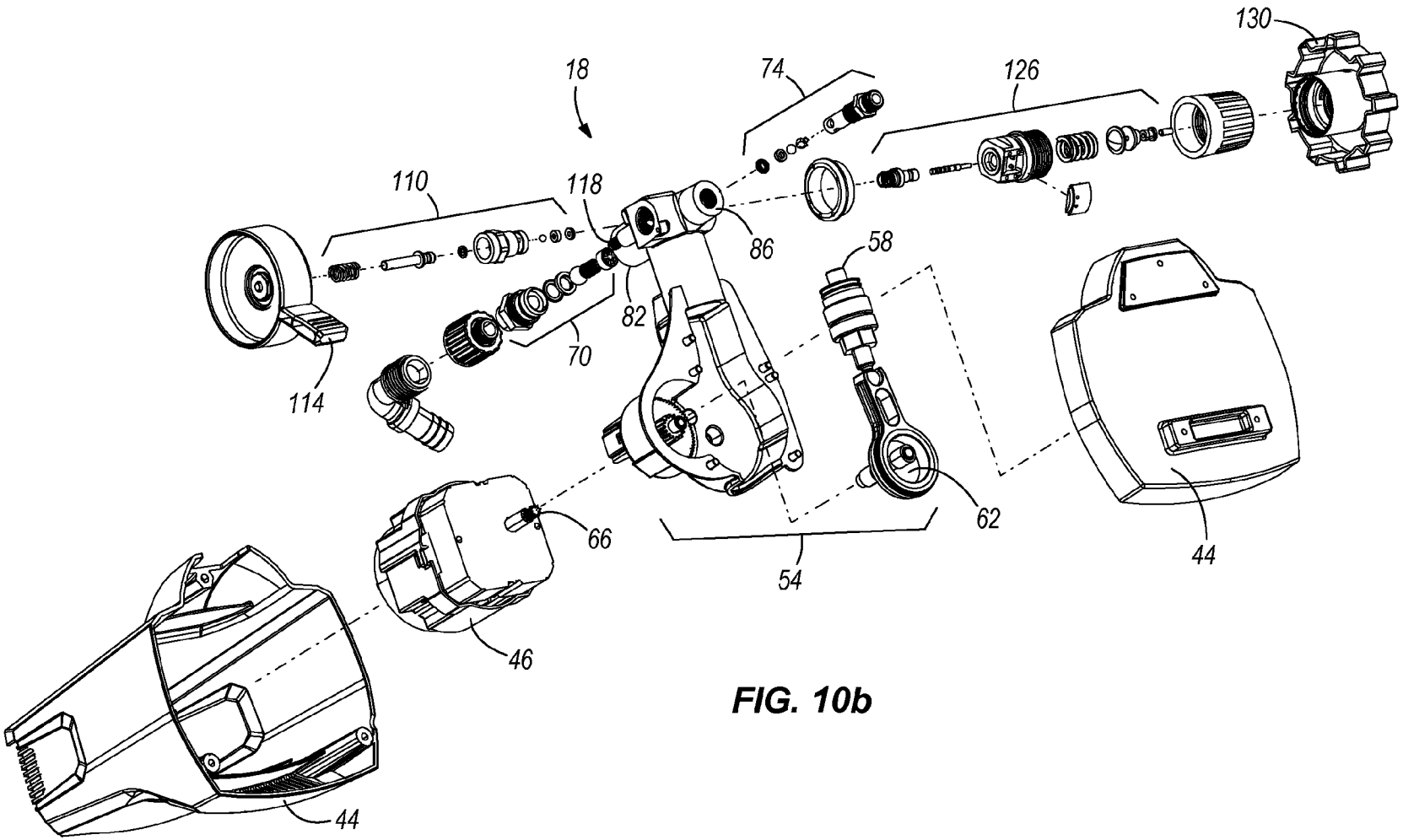
FIG. 10*b* is an enlarged view of a pump/motor assembly illustrated in FIG. 10*a*.
Figure 11A:
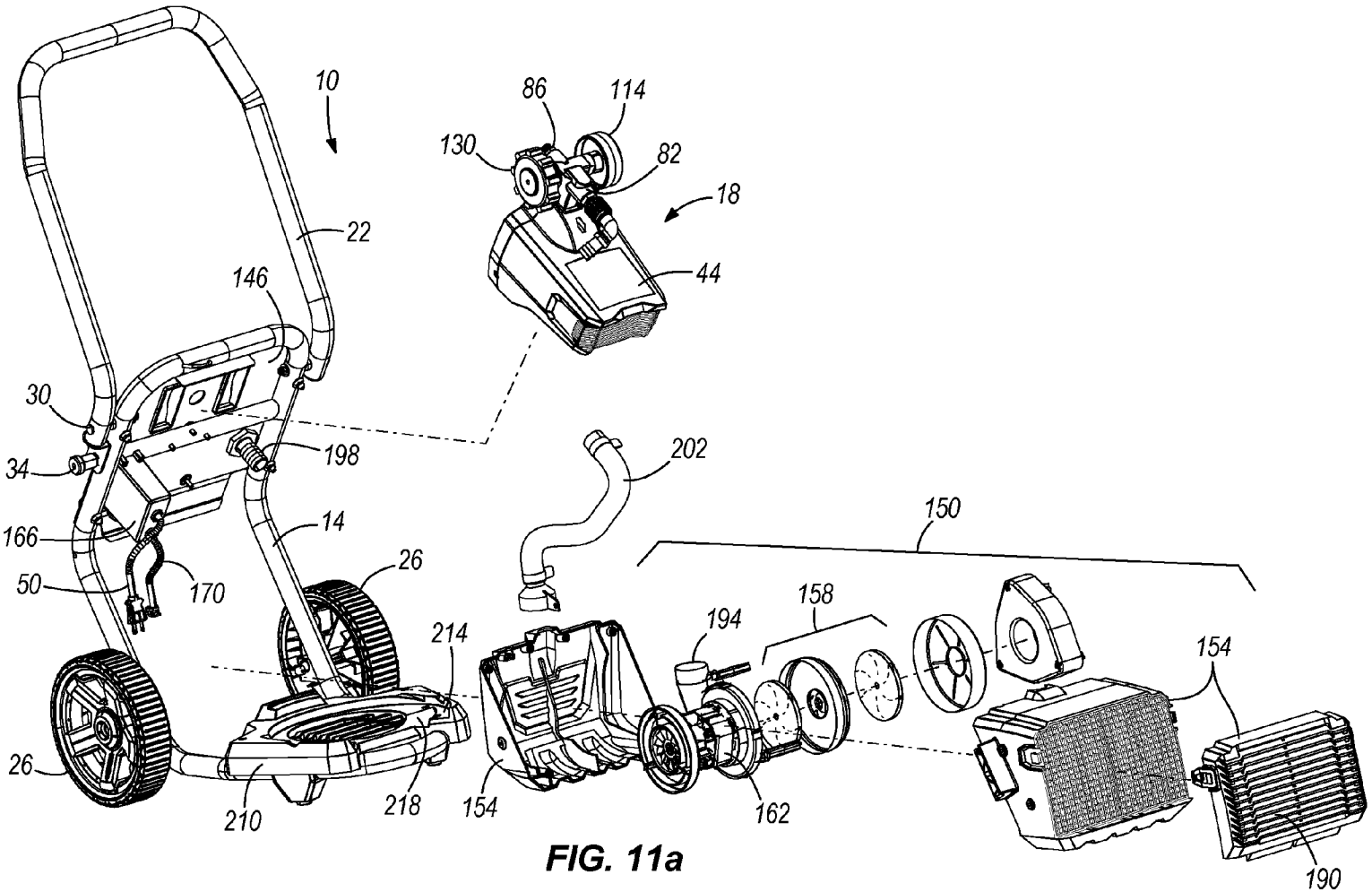
FIG. 11*a* is an exploded, reverse perspective view of the paint sprayer of FIG. 9.
Figure 11B:
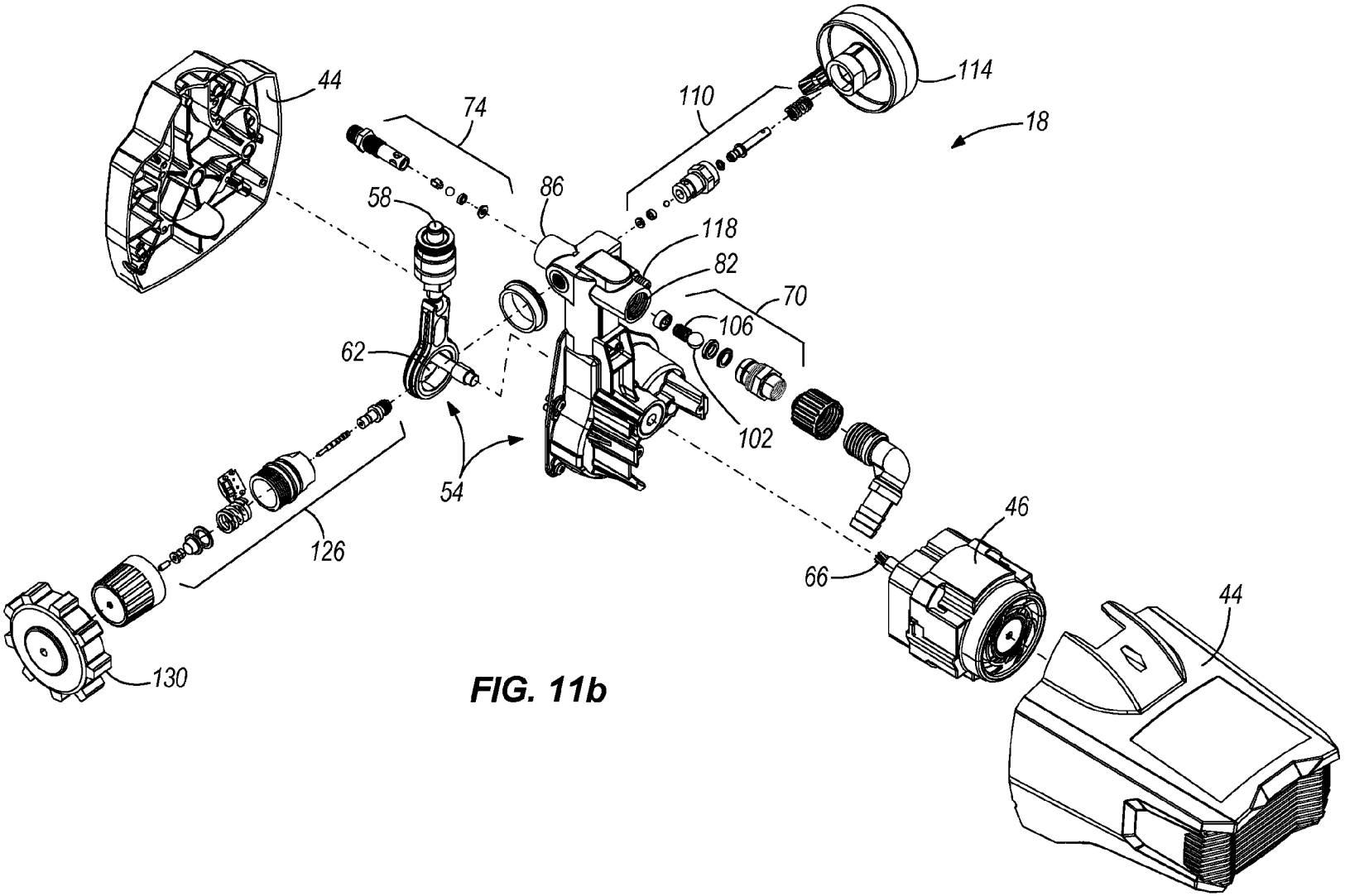
FIG. 11*b* is an enlarged view of the pump/motor assembly illustrated in FIG. 11*a*.

With reference to FIGS. 8 and 9, and as is described in greater detail below, the pump/motor assembly 18 draws paint from a paint source (e.g., a paint bucket or container 38), pressurizes the paint, and discharges the pressurized paint toward a spray gun 42 in a manner similar to an airless paint sprayer. With reference to FIGS. 10*b* and 11*b*, the pump/motor assembly 18 includes a housing 44 and an electric motor 46 (e.g., an AC electric motor) enclosed within the housing 44 and electrically connectable to a power source (e.g., household line current) via a power cord 50 (FIG. 9). Alternatively, the paint sprayer 10 may include an on-board power source (e.g., a battery), and the electric motor 46 may be configured as a DC electric motor to receive power from the battery.

Figure 13:
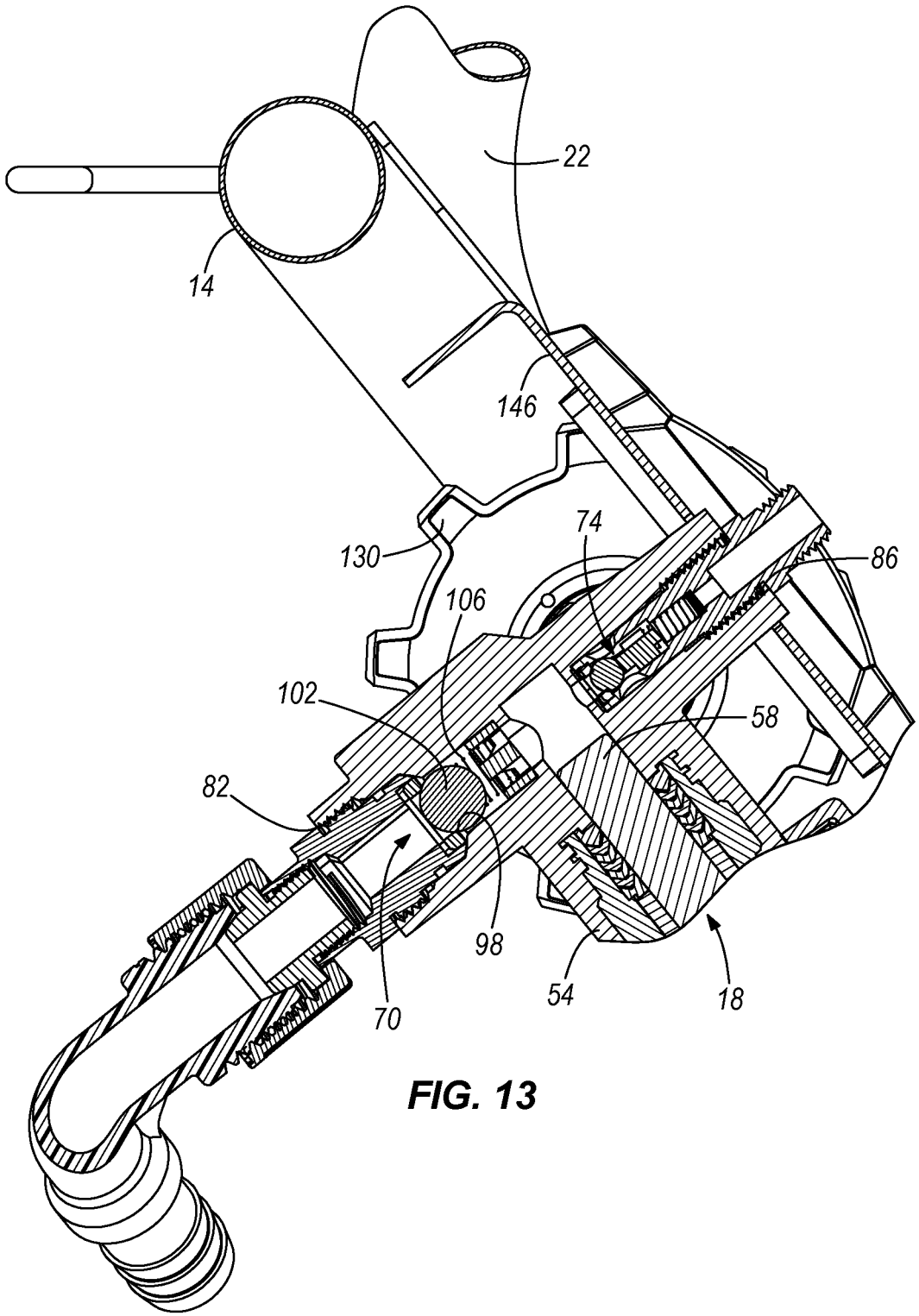
FIG. 13 is a cross-sectional view, taken along line 13-13 in FIG. 9, through a pump manifold of the paint sprayer of FIG. 8.

With reference to FIGS. 10*b* and 11*b*, the pump/motor assembly 18 also includes an axial piston pump 54 operably coupled to the motor 46. More specifically, the axial piston pump 54 includes a single piston 58 and an eccentric 62 coupled to an output shaft 66 of the motor 46 (see also FIG. 13). During operation of the pump/motor assembly 18, as is described in greater detail below, rotation of the motor output shaft 66 and the eccentric 62 imparts reciprocating axial movement to the piston 58 which, in turn, performs work on a discrete volume of paint to pressurize and discharge the paint. With reference to FIG. 13, downward movement of the piston 58 draws a discrete volume of paint through a one-way inlet check valve 70 and into the cylinder of the piston 58. Subsequent upward movement of the piston 58 discharges the volume of paint through another one-way check valve 74 to the spray gun 42. Alternatively, the pump/motor assembly 18 may include a different type of pump besides the axial piston pump 54.

With reference to FIGS. 10*b* and 11*b*, the pump 54 also includes an inlet 82 through which paint is drawn from the paint container 38 and an outlet 86 through which the pressurized paint is discharged. With reference to FIG. 9, a suction tube 90 fluidly communicates the pump inlet 82 and the paint container 38, while a high-pressure hose 94 fluidly communicates the pump outlet 86 and the spray gun 42 (described in more detail below). With reference to FIGS. 11*b* and 13, the inlet check valve 70 is positioned in the pump inlet 82 upstream of the piston cylinder and piston 58. The inlet check valve 70 includes a seat 98, a sealing member (e.g., a ball 102) selectively positioned against the seat 98 to block fluid flow past the seat 98, and a biasing member (e.g., a compression spring 106) biasing the ball 102 against the seat 98. As shown in FIG. 9, the pump inlet 82 and the inlet check valve 70 are oriented obliquely with respect to the ground upon which the paint sprayer 10 is supported. Because the compression spring 106 biases the ball 102 against the seat 98 regardless of the orientation of the pump 54, the pump 54 may be oriented in any of a number of different ways with respect to the ground. As is described in greater detail below, the inlet check valve 70 facilitates priming the pump 54 when the paint sprayer 10 is initially turned on.

With reference to FIGS. 10*b* and 11*b*, the paint sprayer 10 also includes a priming valve 110 positioned between the pump inlet 82 and the pump outlet 86 and an actuator 114 (e.g., a lever) operably coupled to the priming valve 110 to actuate the priming valve 110 between a first position and a second position. In the first position, paint is drawn through the pump inlet 82, pressurized by the pump 54, and redirected to the paint container 38 via a return port 118 in the pump 54 and a return tube 122 fluidly communicating the return port 118 and the paint container 38 (FIG. 9). In the second position, paint is drawn through the pump inlet 82, pressurized by the pump 54, and discharged through the pump outlet 86 toward the spray gun 42. In other words, when the priming valve 110 is in the first position, paint is incrementally drawn through the suction tube 90 and into the pump inlet 82 to feed the pump 54 until a sufficiently continuous supply of paint is available to the pump 54 in the pump inlet 82. The inlet check valve 70, as described above, substantially prevents paint in the pump inlet 86 from returning or draining back to the paint container 38 through the suction tube 90 while the pump 54 is priming. After the pump 54 is sufficiently primed, a user of the paint sprayer 10 manually actuates the lever 114 to the second position to initiate delivery of the pressurized paint through the pump outlet 86 to the spray gun 42. Alternatively, the paint sprayer 10 includes a priming valve that automatically switches to the second position when the pump 54 is sufficiently primed. Likewise, such an automatic priming valve may also automatically switch to the first position to prime the pump 54 when the paint sprayer 10 is initially turned on.

With reference to FIGS. 10*b* and 11*b*, the paint sprayer 10 includes a valve 126 positioned between the inlet 82 and the outlet 86 that is operable to regulate the pressure and/or the flow rate of the pressurized paint discharged by the pump 54 through the outlet 86 to the spray gun 42. The paint sprayer 10 also includes an actuator 130 (e.g., a dial) operably coupled to the regulating valve 126 to adjust the pressure and/or flow rate of the pressurized paint discharged through the pump outlet 86. A user of the paint sprayer 10 rotates the dial 130 in a first direction to increase the flow rate of the pressurized paint that is delivered to the spray gun 42, and a second direction to decrease the flow rate of the pressurized paint that is delivered to the spray gun 42.

Figure 12:
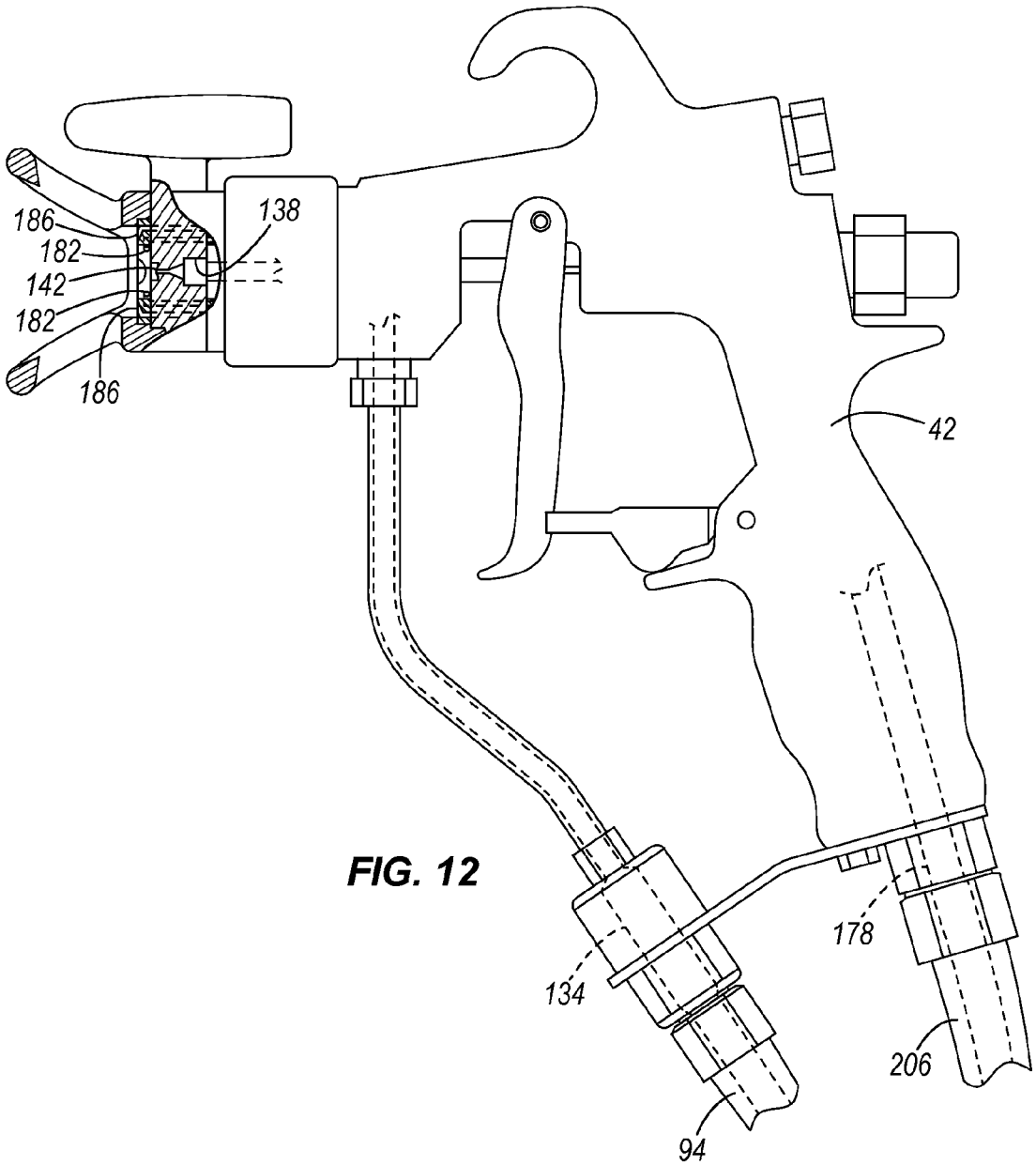
FIG. 12 is an enlarged, side cutaway view of the spray gun of FIG. 8.

With reference to FIG. 12, the spray gun 42 includes a paint inlet 134, a paint outlet 138, a passageway through the spray gun 42 fluidly connecting the paint inlet 134 and the paint outlet 138, and an orifice 142 positioned in the paint outlet 138 through which the pressurized paint is discharged to facilitate atomization of the discharged paint. Adjusting the regulating valve 126 to increase the flow rate of the pressurized paint through the pump outlet 86, therefore, increases the pressure of the paint contained in the high-pressure paint hose 94 because the size of the orifice 142 in the paint outlet 138 remains constant. As a result, the spray gun 42 will discharge the pressurized paint at an increased pressure, leading to an increased amount of paint that is applied to a surface or workpiece. Likewise, adjusting the regulating valve 126 to decrease the flow rate of the pressurized paint through the pump outlet 86 also decreases the pressure of the paint contained in the high-pressure paint hose 94. As a result, the spray gun 42 will discharge the pressurized paint at a decreased pressure, leading to a decreased amount of paint that is applied to a surface or workpiece.

With reference to FIG. 8, the paint sprayer 10 includes a control panel 146 coupled to the frame 14 (e.g., using fasteners, welding, integrally forming, etc.). The control panel 146 includes respective apertures through which the pump outlet 86, the priming lever 114, and the regulator dial 130 are at least partially received. In this manner, the user of the paint sprayer 10 manipulates the lever 114 and the dial 130 from a front side of the control panel 146 (i.e., the side of the control panel 146 visible in FIG. 8) without having to access different locations on the paint sprayer 10 to adjust the regulating valve 126 and the priming valve 110. In addition, the user of the paint sprayer 10 interconnects the high-pressure paint hose 94 to the pump outlet 86 at a location on the paint sprayer 10 that is elevated from the ground, thereby enhancing the ease of use of the paint sprayer 10 over other paint sprayer designs, which include pump outlets disposed toward the bottom of the paint sprayer near the ground.

With reference to FIGS. 8 and 9, the paint sprayer 10 also includes a blower 150 supported by the frame 14 and operable to discharge jets of pressurized air into the pressurized paint spray discharged by the pump 54. As shown in FIGS. 10*a* and 11*a*, the blower 150 includes a housing 154 supported by the frame 14, a centrifugal fan 158 rotatably supported within the housing 154, and a motor 162 (e.g., an AC electric motor) operably coupled to the fan 158 to rotate the fan 158. In the illustrated construction, the blower motor 162 is electrically connected to the same power source to which the pump motor 46 is electrically connected using a junction box 166 and an electrical cord 170 (FIG. 9). With reference to FIG. 8, the junction box 166 includes a switch 174 that is manipulatable by the user of the paint sprayer 10 to selectively activate and deactivate the blower 150. With reference to FIG. 12, the spray gun 42 includes an air inlet 178, a plurality of air outlets 182, 186 surrounding the paint outlet 138, and an air passageway fluidly connecting the air inlet 178 and the plurality of air outlets 182, 186. Specifically, the air outlets 182 are directed radially inwardly toward the center of the pressurized paint spray, while the air outlets 186 are directed obliquely inwardly toward the outermost edges of the pressurized paint spray. As is discussed in greater detail below, the blower 150 may be utilized to increase the atomization of the pressurized paint that is discharged from the spray gun 42 by discharging jets of pressurized air from the spray gun 42 (via the air outlets 182, 186 surrounding the single paint outlet 138) to intersect the spray of pressurized paint from the spray gun 42.

With reference to FIG. 11*a*, the housing 154 includes a plurality of air inlet slots 190 on a side of the housing 154 facing the paint container 38 through which inlet air is drawn by the fan 158. The blower 150 includes an outlet 194 through which pressurized air generated by the fan 158 is discharged. The paint sprayer 10 further includes a remote blower outlet 198 coupled to the control panel 146 and an adapter hose 202 fluidly connecting the remote blower outlet 198 and the blower outlet 194 (FIGS. 10*a* and 11*a*). As shown in FIG. 8, a low-pressure hose 206 fluidly connects the remote blower outlet 198 and the air inlet 178 of the spray gun 42 to transfer pressurized air generated by the blower 150 to the spray gun 42. In this manner, the user of the paint sprayer 10 may interconnect the low-pressure air hose 206 to the remote blower outlet 198 at a location on the paint sprayer 10 that is elevated from the ground.

Figure 14:
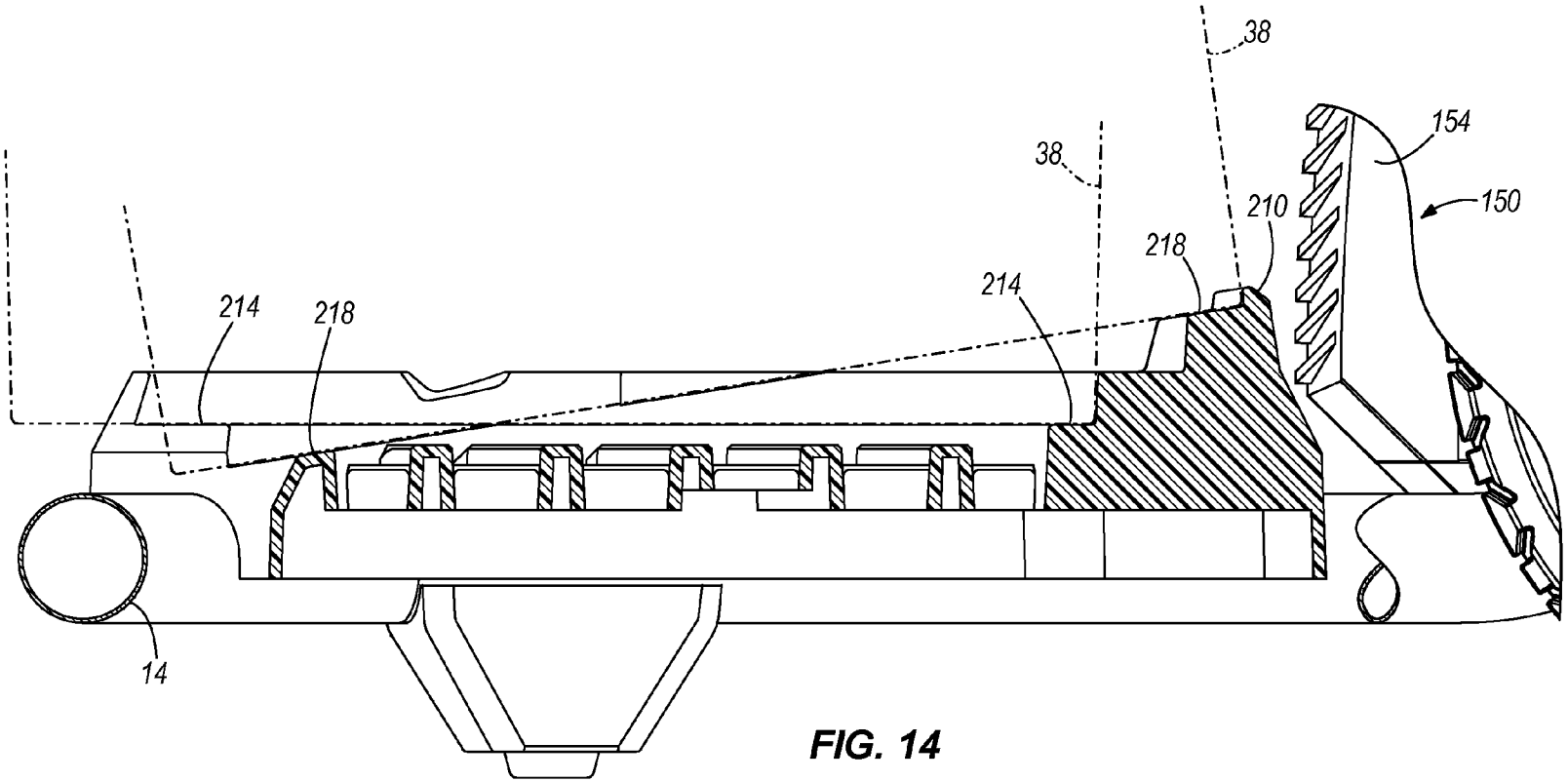
FIG. 14 is a cross-sectional view through a platform of the paint sprayer of FIG. 8.

With reference to FIGS. 9, 10*a*, and 11*a*, the paint sprayer 10 includes a platform 210 coupled to the frame 14 upon which the paint container 38 is supported. As shown in FIG. 9, the platform 210 is coupled to a rear of the frame 14 such that a rear of the control panel 146 faces the paint container 38. As a result, the amount of splattered paint that reaches the front of the control panel 146 (i.e., the side of the control panel 146 accessible by the user to manipulate the lever 114 and the dial 130) during use of the paint sprayer 10 is reduced. The platform 210 is fastened to the frame 14 using a plurality of fasteners (e.g., screws or bolts). Alternatively, the platform 210 may be secured to the frame 14 in any of a number of different ways (e.g., using quick-connect structure, using adhesives, welding, etc.). As a further alternative, the platform 210 may be integrally formed as a single piece with the frame 14. With reference to FIG. 14, the platform 210 includes two separate and distinct support surfaces 214, 218 upon which the paint container 38 may be supported. The first support surface 214 is oriented substantially parallel with the ground such that a central axis of the paint container 38 is oriented substantially normal to the ground when the paint sprayer 10 is in use (FIG. 14). The second support surface 218 is inclined at an oblique angle (e.g., 5 degrees or less) with respect to the first support surface 214.

Figure 16:
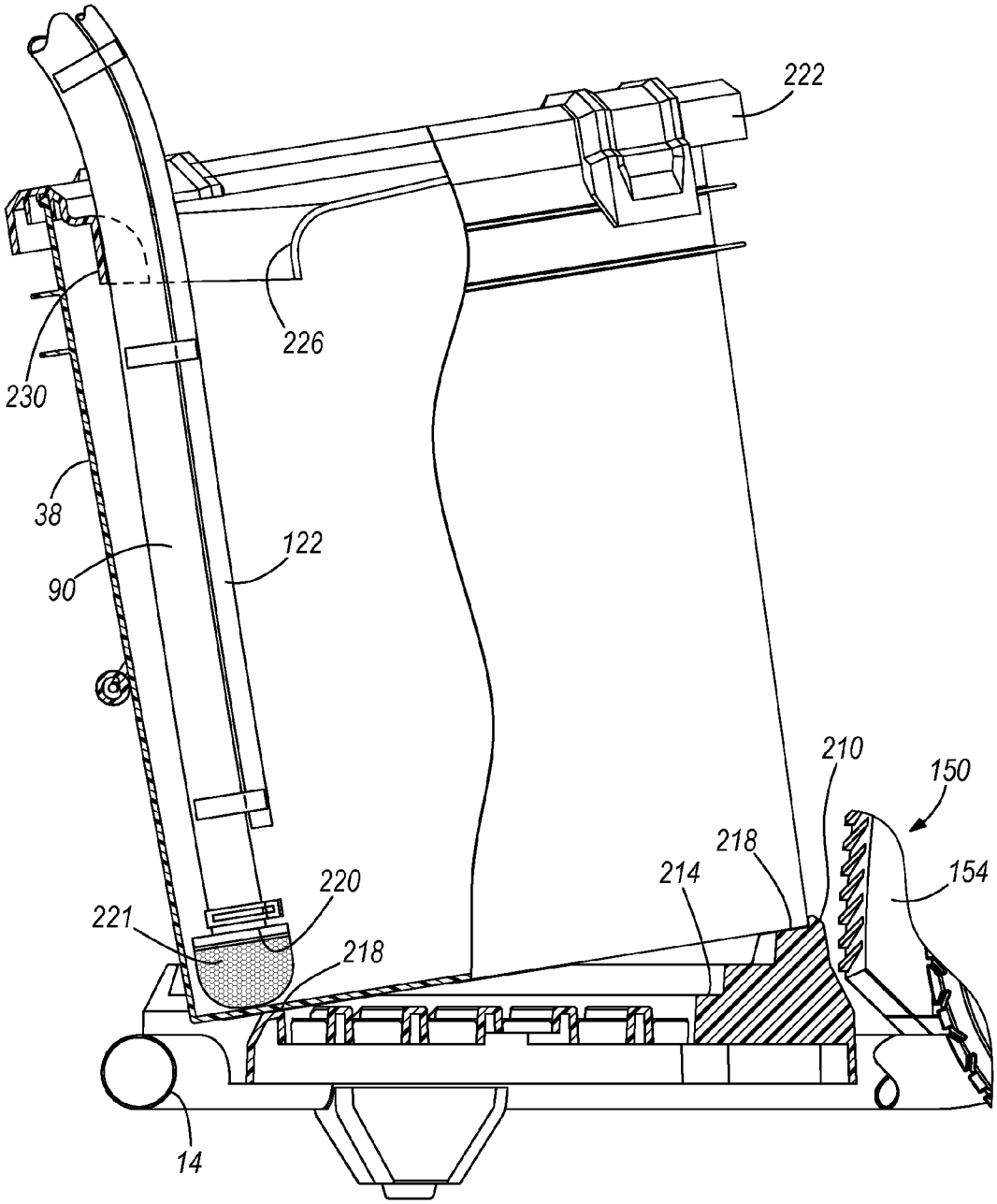
FIG. 16 is an enlarged, side cutaway view of the paint container and lid oriented at an incline on the platform of the paint sprayer of FIG. 8.

As shown in FIG. 16, when the paint container 38 is supported on the inclined support surface 218, the paint in the paint container 38 tends to collect near a bottom-most corner of the paint container 38, thereby allowing more of the paint in the paint container 38 to be suctioned into the pump 54 when an inlet 220 of the suction tube 90 is positioned in the bottom-most corner of the paint container 38. In the illustrated construction, a filter 221 is coupled to the inlet 220 of the suction tube 90 (e.g., by a clamp, etc.) to substantially prevent debris in the paint container 38 from being suctioned into the pump 54; however, in further constructions the filter may not be included. With reference to FIG. 9, when the paint container 38 is supported on the substantially horizontal surface 214 of the platform 210, the bottom of the paint container 38 is supported by the platform 210, and the side of the paint container 38 is at least partially supported by the housing 44 of the pump/motor assembly 18 during transport of the paint sprayer 10. A retention member (e.g., a bungee cord) may be utilized to retain the paint container 38 to the platform 210. Alternatively, other retention members may be utilized to retain the paint container 38 to the platform 210 (e.g., clamps coupled to the platform 210 etc.).

Figure 15:
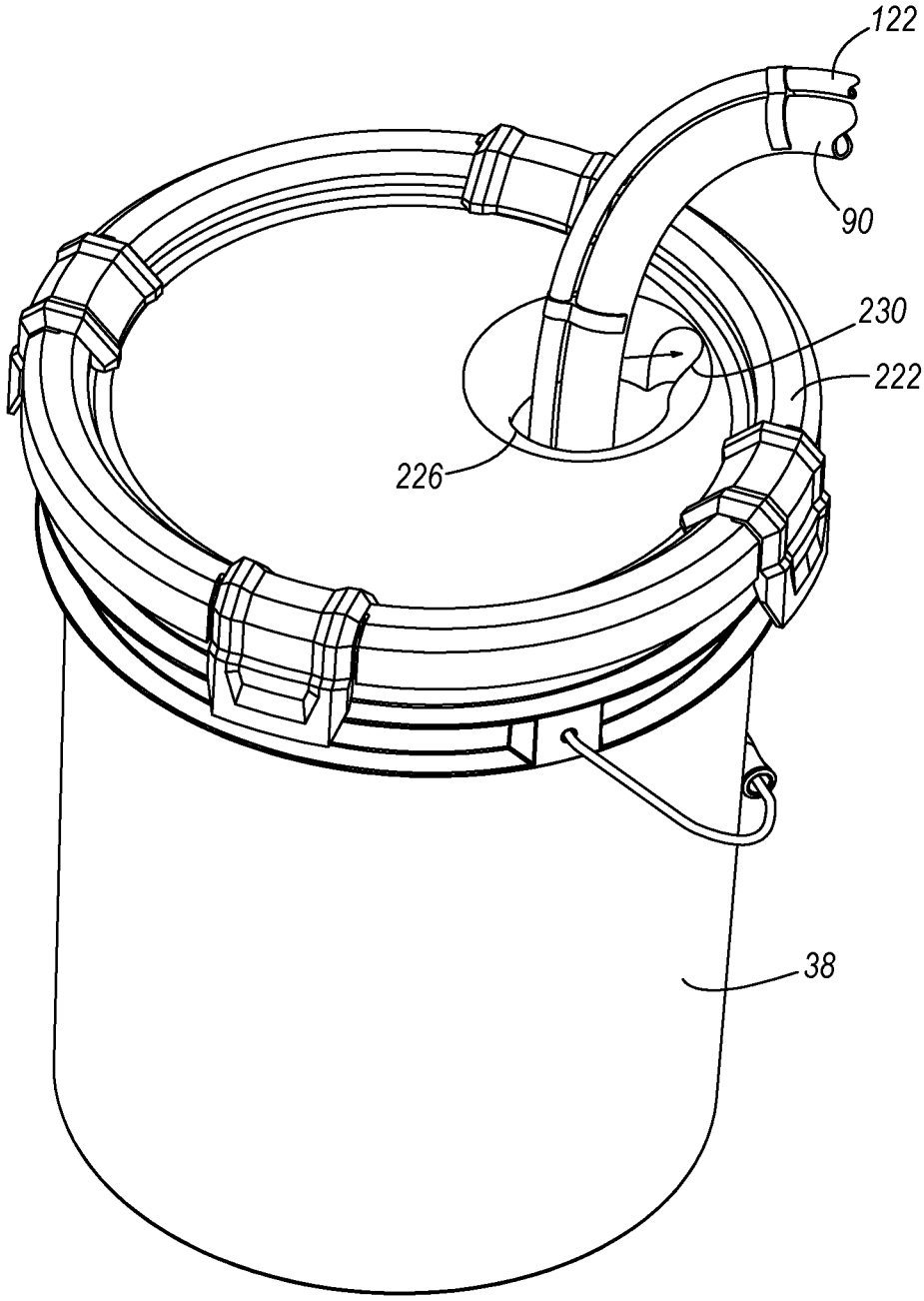
FIG. 15 is an enlarged, top perspective view of a paint container and lid of the paint sprayer of FIG. 8.

With reference to FIGS. 15 and 16, the paint sprayer 10 includes a cover or lid 222 attached to the paint container 38 (e.g., a 5-gallon paint container). The lid 222 includes an aperture 226 through which the suction tube 90 is received. The lid 222 also includes a retainer 230 integrally formed with the lid 222 adjacent the aperture 226. Specifically, the retainer 230 is configured having a C-shaped cross-section, and is sized to provide a snap-fit with the suction tube 90 to secure the suction tube 90 to the lid 222 and the paint container 38. As such, the suction tube 90 is retained and secured to the lid 222 such that the inlet of the suction tube 90 is maintained in the bottom-most corner of the paint container 38 when the paint container 38 is positioned on the inclined support surface 218 of the platform 210 (FIG. 16). Alternatively, the retainer 230 may have any of a number of different configurations to secure the suction tube 90 to the lid 222 and maintain the inlet of the suction tube 90 in the bottom-most corner of the paint container 38 to draw or suction substantially all of the paint from the paint container 38. Further, the retainer 230 may be separately formed from the lid 222 and positioned within or adjacent to the aperture 226 of the lid 222.

Figure 17:
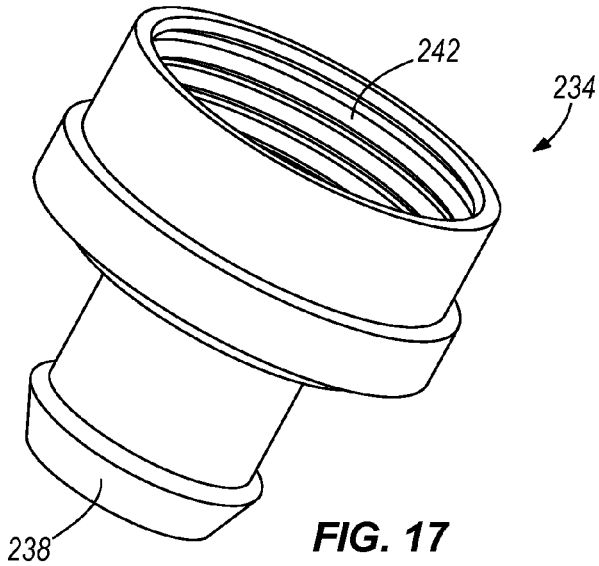
FIG. 17 is an enlarged perspective view of a garden hose adapter utilized for flushing the paint sprayer of FIG. 8.
Figure 18:
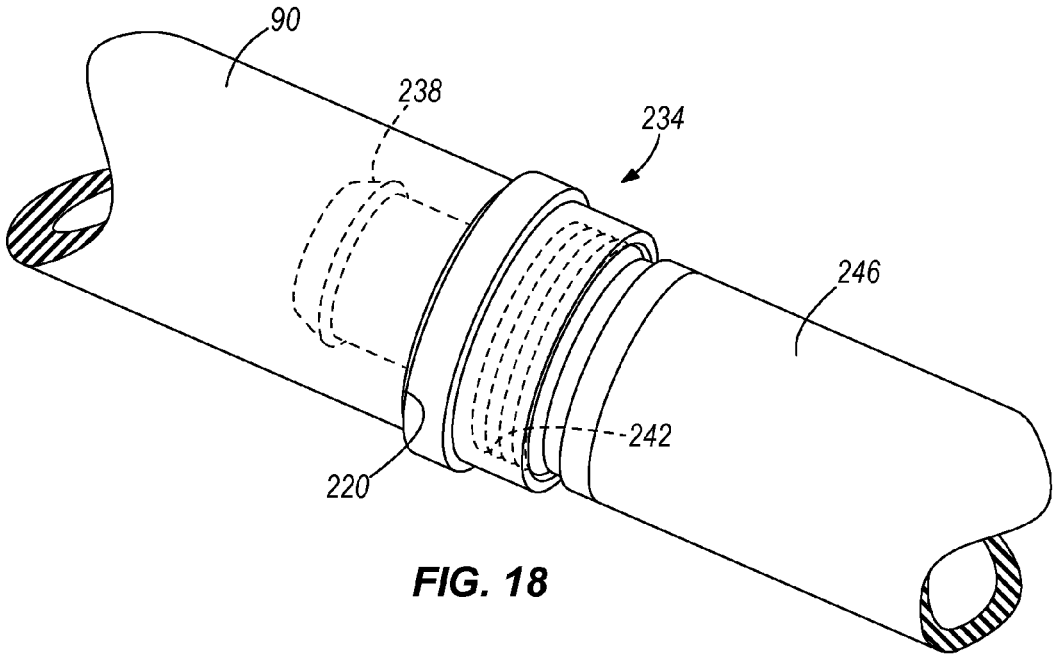
FIG. 18 is a perspective view of the garden hose adapter of FIG. 17 interconnecting a suction hose of the paint sprayer of FIG. 8 and a garden hose.

With reference to FIG. 17, the paint sprayer 10 also includes a garden hose adapter 234 having a nipple 238 on one end that is received within the inlet of the suction tube 90 and a threaded portion 242 on an opposite end for coupling to a garden hose 246 (see also FIG. 18). A clamp (e.g., a hose clamp) may be used to secure the inlet of the suction tube 90 to the nipple 238 to substantially prevent accidental disconnection of the adapter 234 from the suction tube 90. As is described in greater detail below, the adapter 234 is used to adapt the inlet of the suction tube 90 to the garden hose 246 to flush water through the pump 54 to clean the pump 54.

With reference to FIGS. 8 and 9, the paint sprayer 10 includes a storage compartment 250 coupled to the handle 22 and having receptacles 254 in which to receive accessories for the paint sprayer 10 (e.g., the garden hose adapter 234, the spray gun 42, etc.). In the illustrated construction, the storage compartment 250 is strapped to the tubular members of the frame 14 using hook-and-loop fasteners (e.g., Velcro® brand hook-and-loop fasteners). In further constructions, the storage compartment 250 may be coupled to the handle 22 or frame 14 in any of a number of different ways. As a further alternative, the storage compartment 250 may be integrally formed with the handle 22 or frame 14 as a single piece.

Figure 20:
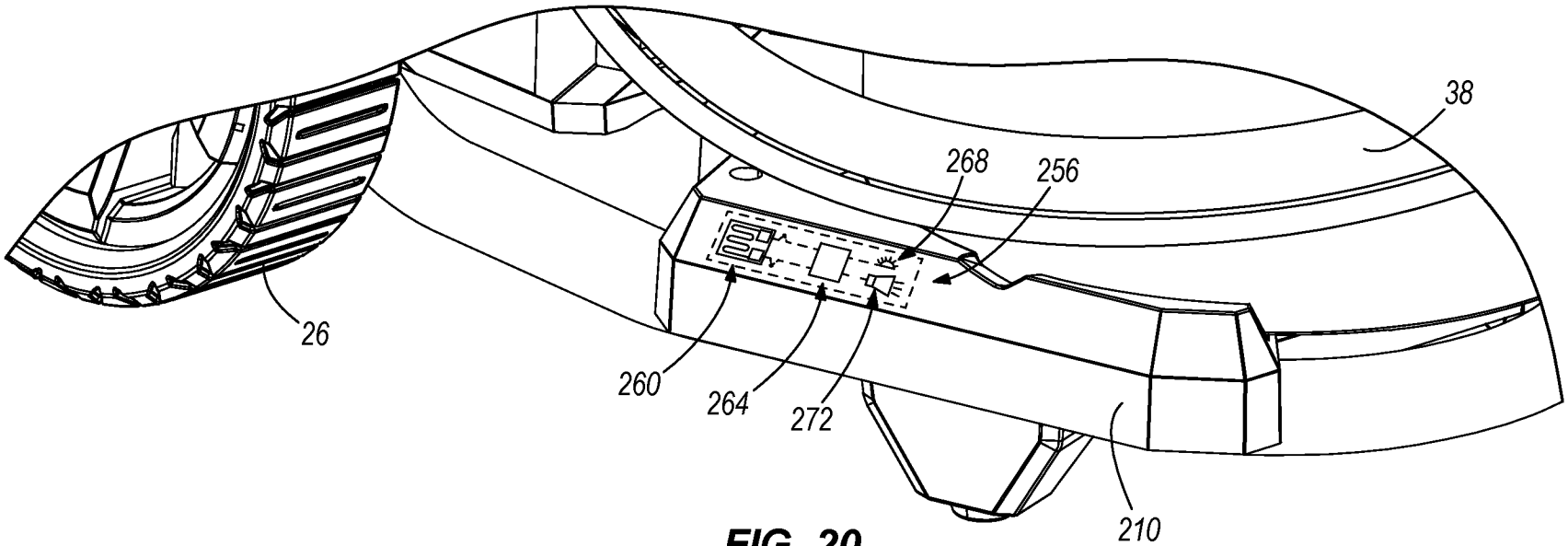
FIG. 20 is an enlarged, front perspective view of the paint sprayer of FIG. 8, illustrating a paint level indicator on the platform of the paint sprayer.
Figure 21:
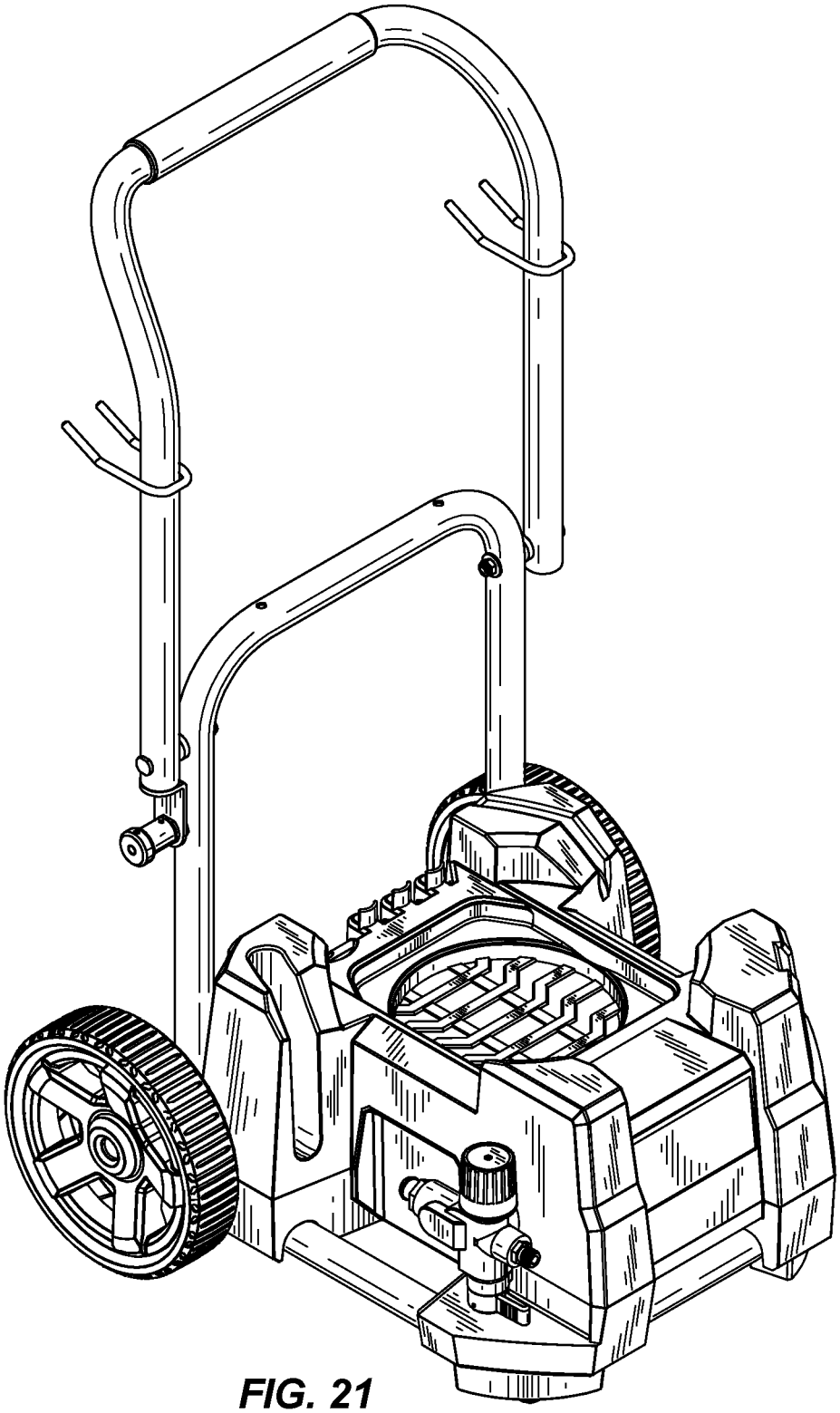
FIG. 21 is a front perspective view of a paint sprayer according to another embodiment of the invention.
Figure 22:
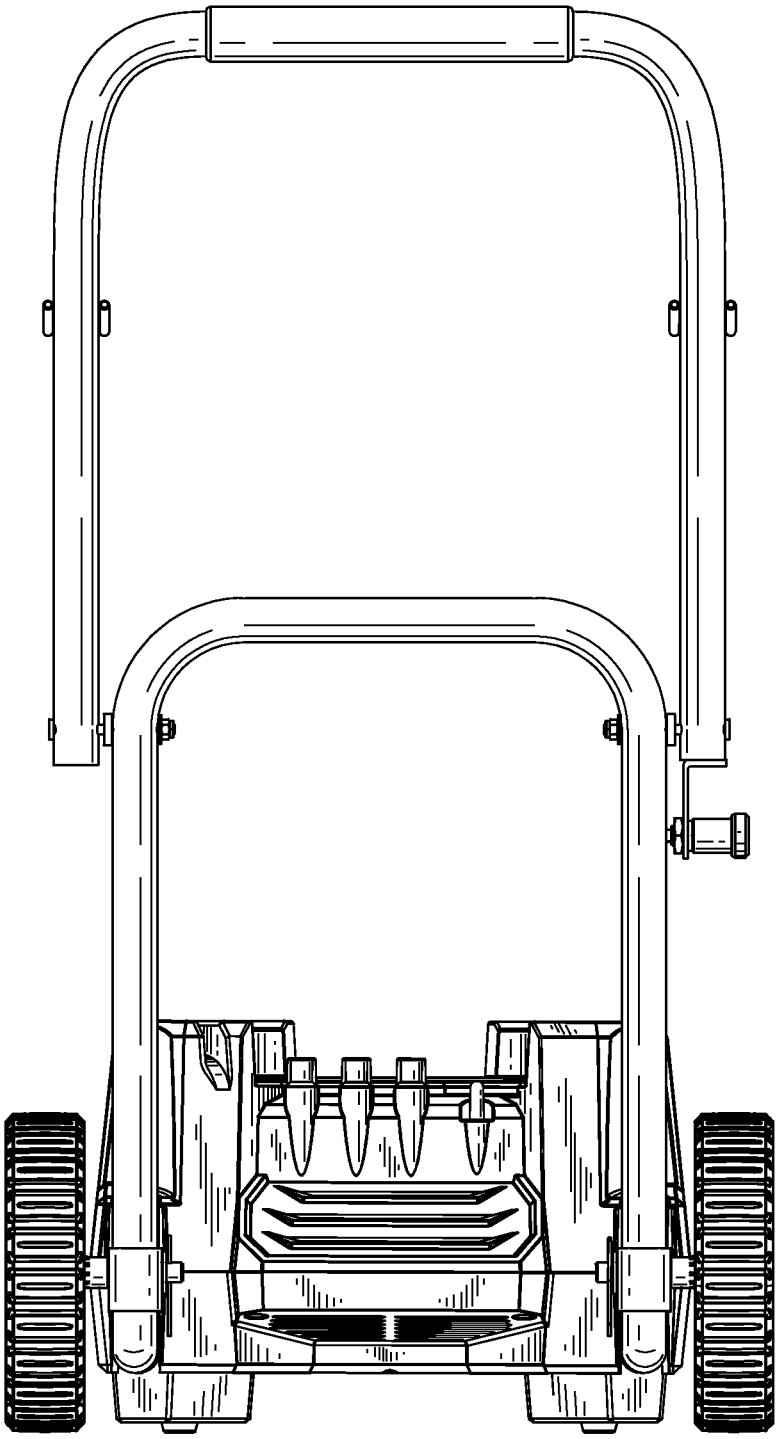
FIG. 22 is a front view of the paint sprayer of FIG. 21.
Figure 23:
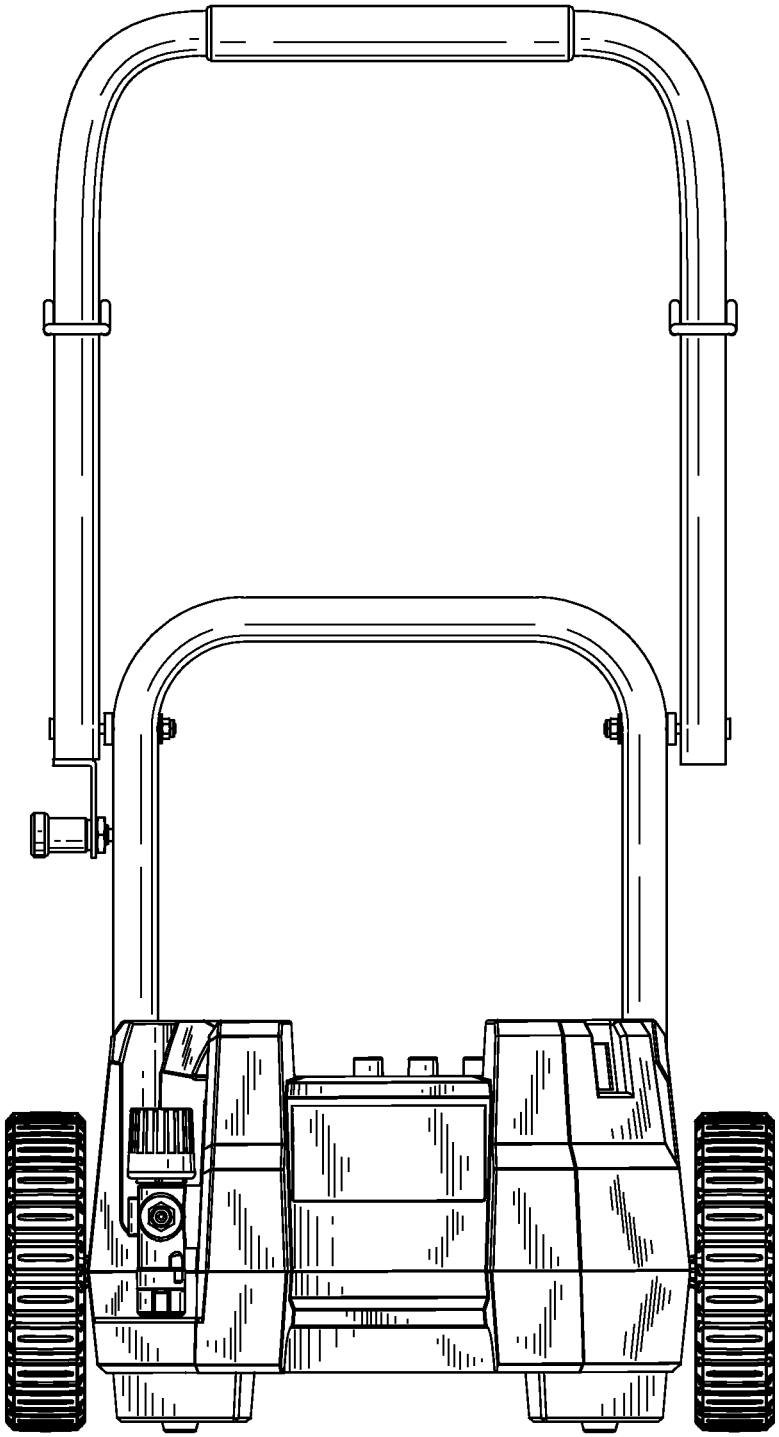
FIG. 23 is a rear view of the paint sprayer of FIG. 21.
Figure 24:
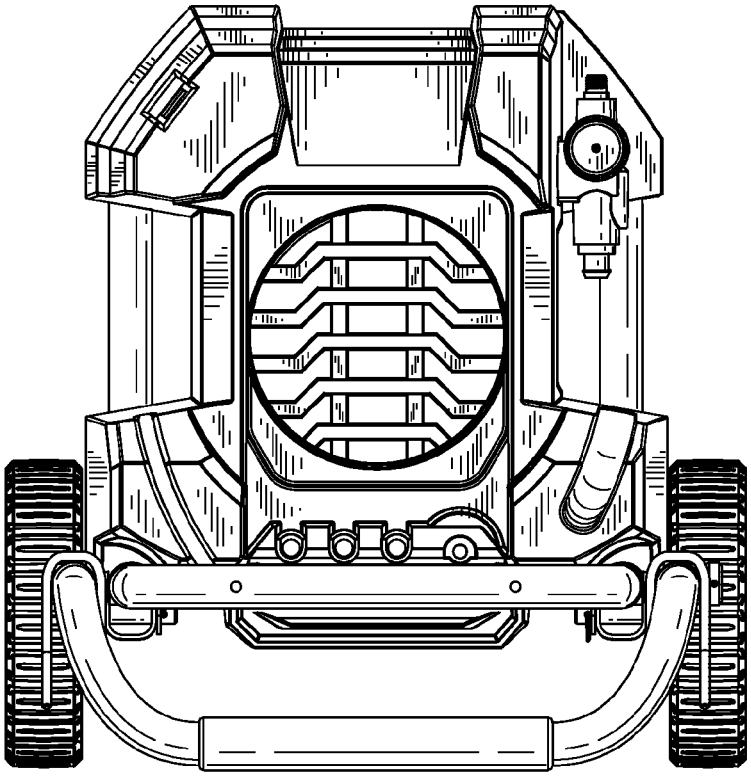
FIG. 24 is a top view of the paint sprayer of FIG. 21.
Figure 25:
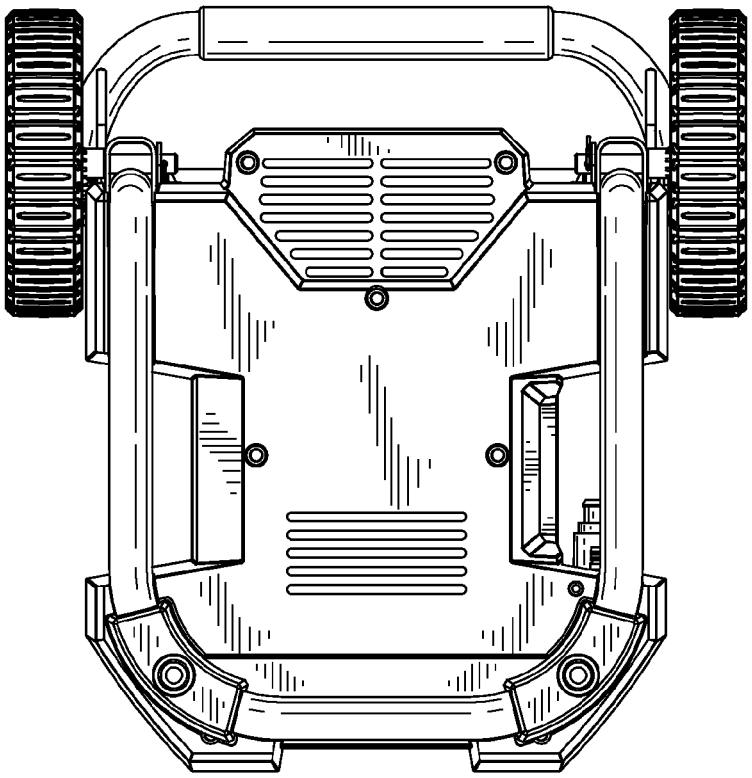
FIG. 25 is a bottom view of the paint sprayer of FIG. 21.
Figure 26:
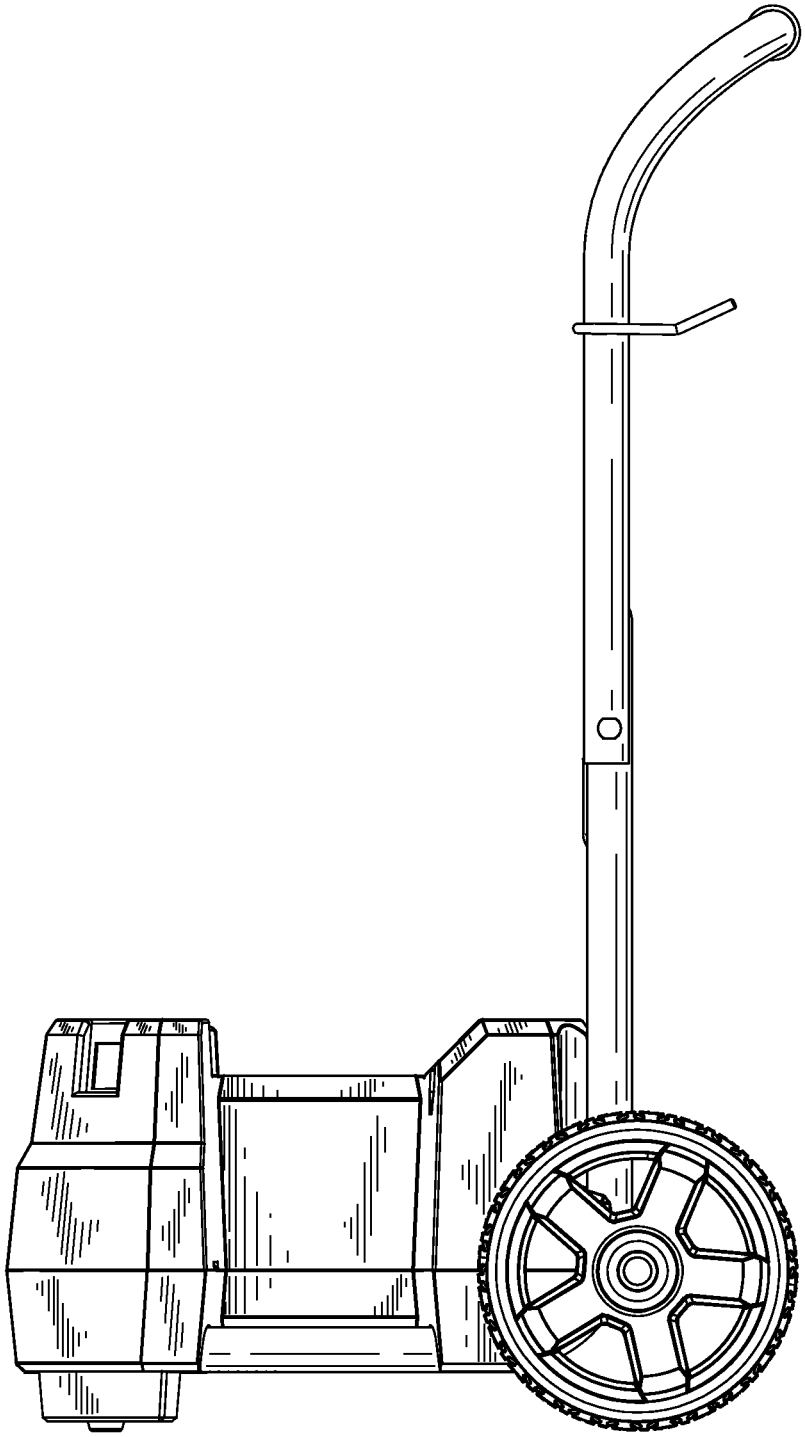
FIG. 26 is a left side view of the paint sprayer of FIG. 21.
Figure 27:
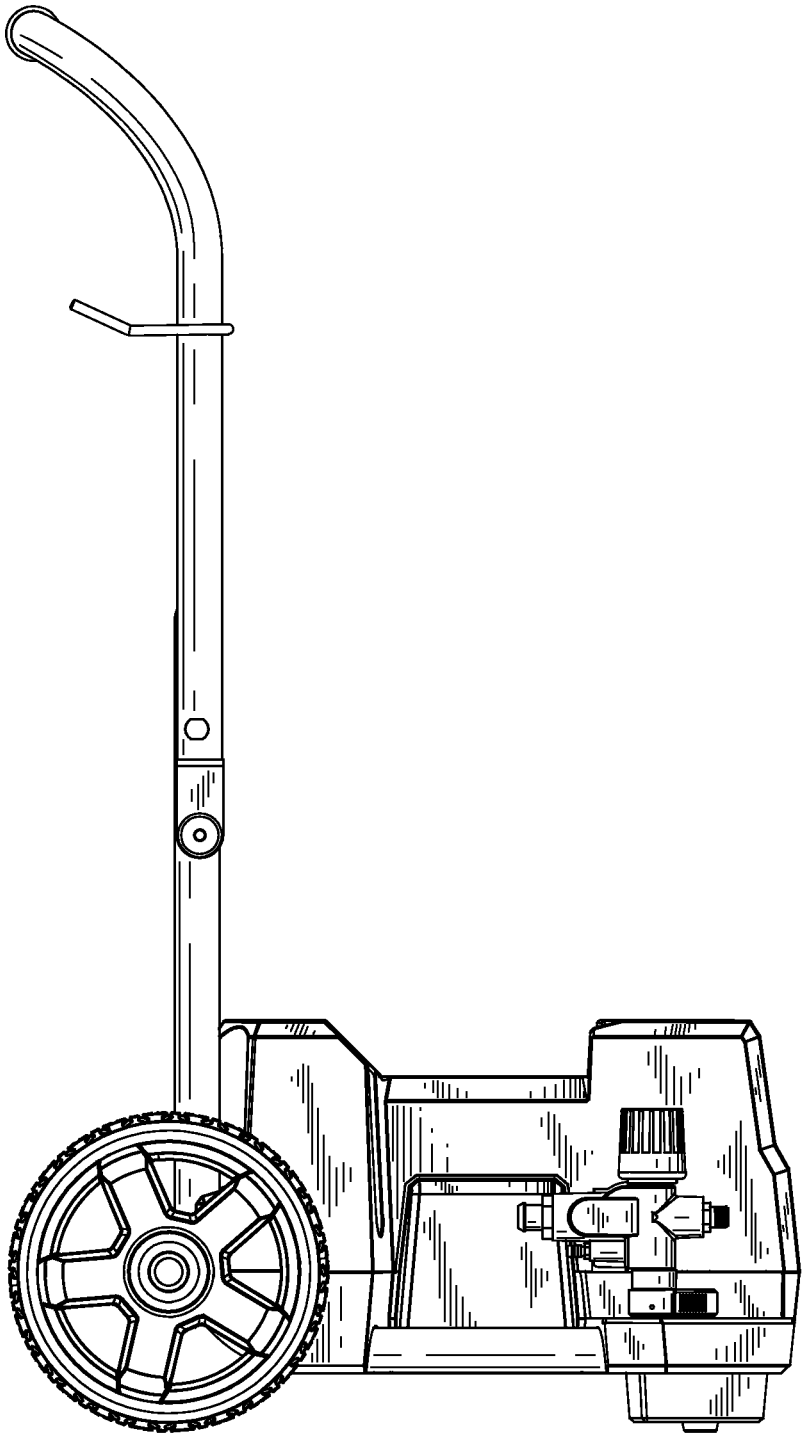
FIG. 27 is a right side view of the paint sprayer of FIG. 21.

With reference to FIG. 20, the paint sprayer 10 includes a paint level indicator 256 coupled to the platform 210. The paint level indicator 256 includes a strain gauge 260 positioned beneath one or each of the support surfaces 214, 218 of the platform 210, an electrical circuit 264 in electrical communication with the strain gauge 260, and one of a visual indicator 268 (e.g., an LED indicator) and an aural indicator 272 (e.g., a buzzer) in electrical communication with the circuit 264. In operation of the paint level indicator 256, the strain gauge 260 outputs an electrical signal to the circuit 264 that is proportional to the weight of the container 38 and its contents (i.e., paint). The electrical circuit 264, in turn, is operable to trigger either or both of the visual indicator 268 and the aural indicator 272 when the level of paint in the container 38 becomes low. Alternatively, other components may be employed with the paint level indicator 256 to determine the amount of paint remaining in the container 38 when the sprayer 10 is in use (e.g., one or more microswitches employed with a movable support surface), or the paint sprayer 10 may not include a paint level indicator.

To use the paint sprayer 10, a user first secures the lid 222 to the open end of the paint container 38 and positions the paint container 38 on one of the support surfaces 214, 218 of the platform 210. To increase the amount of paint that is suctioned or drawn from the paint container 38 during use of the paint sprayer 10, the user positions the paint container 38 on the inclined support surface 218. Then, the user inserts the inlet of the suction tube 90 through the aperture 226 in the lid 222 and positions the inlet of the suction tube 90 in the bottom-most corner of the paint container 38 (e.g., the position of the suction tube 90 shown in FIG. 16). Optionally, the user inserts the suction tube 90 into the retainer 230 in the lid 222 to secure the suction tube 90 with respect to the lid 222 and maintain the position of the inlet of the suction tube 90 in the bottom-most corner of the paint container 38.

Then, the user of the paint sprayer 10 connects one end of the high-pressure paint hose 94 to the pump outlet 86 and the other end to the paint inlet 134 of the spray gun 42. Should the user desire to use the air-assist feature provided by the blower 150, the user of the paint sprayer 10 then connects one end of the low-pressure air hose 206 to the remote blower outlet 198 and the other end to the air inlet 178 of the spray gun 42.

Before using the paint sprayer 10 to paint any surfaces or workpieces, the user initially primes the pump 54 by moving the lever 114 to the first position and then activating the pump motor 46. When activated, the pump 54 draws paint with entrained air through the suction tube 90 and pump inlet 82, pressurizes the paint/air mixture, and exhausts or redirects the paint/air mixture to the paint container 38 via the return port 118 and the return tube 122 running parallel with the suction tube 90. While the pump 54 is priming, paint is incrementally drawn through the suction tube 90 and into the pump inlet 82 to feed the pump 54 until a sufficiently continuous supply of paint (i.e., without entrained air) is available to the pump 54 in the inlet 82. The inlet check valve 70, as described above, substantially prevents paint in the inlet 82 from returning or draining back to the paint container 38 through the suction tube 90 while the pump 54 is priming. After the pump 54 is sufficiently primed (i.e., when no entrained air is in the paint being returned to the paint container 38 through the return tube 122), the user of the paint sprayer 10 manually actuates or toggles the lever 114 to the second position to initiate delivery of the pressurized paint through the pump outlet 86 to the spray gun 42. The user then depresses a trigger 258 on the spray gun 42 to begin spraying the pressurized paint through the paint outlet 138 of the spray gun 42 (FIG. 12).

At any time during use of the paint sprayer 10, the user may adjust the regulating valve 126 to vary the amount of paint that is ultimately discharged from the spray gun 42. More particularly, the user would adjust the dial 130 to increase or decrease the flow rate of the pressurized paint from the pump outlet 86, and therefore the pressure of the pressurized paint in the high-pressure paint hose 94. Should the user decide to use the paint sprayer 10 purely as an "airless" paint sprayer 10 (i.e., without the air-assist feature provided by the blower 150), it is contemplated that the user would adjust the regulating valve 126 to yield a fluid pressure in the pump outlet 86 of at least about 3,000 pounds per square inch ("psi").

Should a user decide to use the air-assist feature of the paint sprayer 10 provided by the blower 150, the user actuates the switch 174 on the control panel 146 to activate the blower motor 162. The blower motor 162, in turn, rotates the fan 158 to generate an airflow through the blower outlet 194, the adapter hose 202, the remote blower outlet 198 coupled to the control panel 146, and the low-pressure air hose 206. The airflow is then expelled through the plurality of air outlets 182, 186 in the spray gun 42 as individual air jets that intersect the pressurized paint spray from the paint outlet 138 to facilitate or increase atomization of the pressurized paint spray near the center of the spray (with the air outlets 182) and near the outermost edges of the paint spray (with the air outlets 186). The internal valve structure of the spray gun 42 is configured to discharge the air jets and the pressurized paint spray at the same time when the user depresses the trigger 258 of the spray gun 42.

In one mode of operating the paint sprayer 10, it is contemplated that the user adjusts the regulating valve 126 to yield a fluid pressure in the pump outlet 86 between about 500 psi and about 3,000 psi, and that the blower 150 would be operated to generate an airflow of about 60 cubic feet per minute ("cfm") at a pressure between about 3 psi and about 5 psi at the blower outlet 194. An orifice 142 having a diameter between about 0.008 inches and about 0.017 inches may be used in the paint outlet 138 of the spray gun 42 with these pressure ranges (FIG. 12). In another mode of operating the paint sprayer 10, it is contemplated that the user adjusts the regulating valve 126 to yield a fluid pressure in the pump outlet 86 between about 800 psi and about 1,200 psi, and that the blower 150 would be operated to generate an airflow of about 60 cfm at a pressure between about 3.5 psi and about 4.5 psi at the blower outlet 194. An orifice 142 having a diameter of about 0.010 inches may be used in the paint outlet 138 of the spray gun 42 with these pressure ranges to yield a six-inch fan width of the paint spray measured 12 inches from the surface of the workpiece.

When the user is finished using the paint sprayer 10, the user may clean the paint sprayer 10. The user removes the suction tube 90 from the paint container 38 and attaches the garden hose adapter 234 to the inlet of the suction tube 90 as described above. Then, the user attaches the garden hose 246 to the threaded portion 242 of the adapter 234 (FIG. 18) and flushes the pump 54, the high-pressure paint hose 94, and the spray gun 42 with water for cleaning. After the paint sprayer 10 has been cleaned, the user may fold or retract the handle 22 to the storage position (shown in FIG. 19) to enhance the compactness of the paint sprayer 10 for storage.

With reference to FIGS. 1-27 and 28, another embodiment of a paint sprayer 262 includes a frame 266 and a pump/motor assembly (not shown) supported by the frame 266 within a housing 270 upon which a paint container may be supported. In the illustrated construction of the paint sprayer 262, the frame 266 is made from round tubing. Alternatively, the frame 266 may be made with differently shaped structure (e.g., square tube structure, solid bar stock, L-shaped stock, etc.). Also, in the illustrated construction of the paint sprayer 262, a handle 274 and a plurality of wheels 278 are coupled to the frame 266 to facilitate transport of the paint sprayer 262. The handle 274 is pivotably coupled to the frame 266 using a plurality of fasteners (e.g., bolts 282 and a quick-release coupling 286), and is pivotable between an extended position and a retracted position for storage. Alternatively, the handle 274 or the wheels 278 on the paint sprayer 262 may be omitted.

Figure 28:
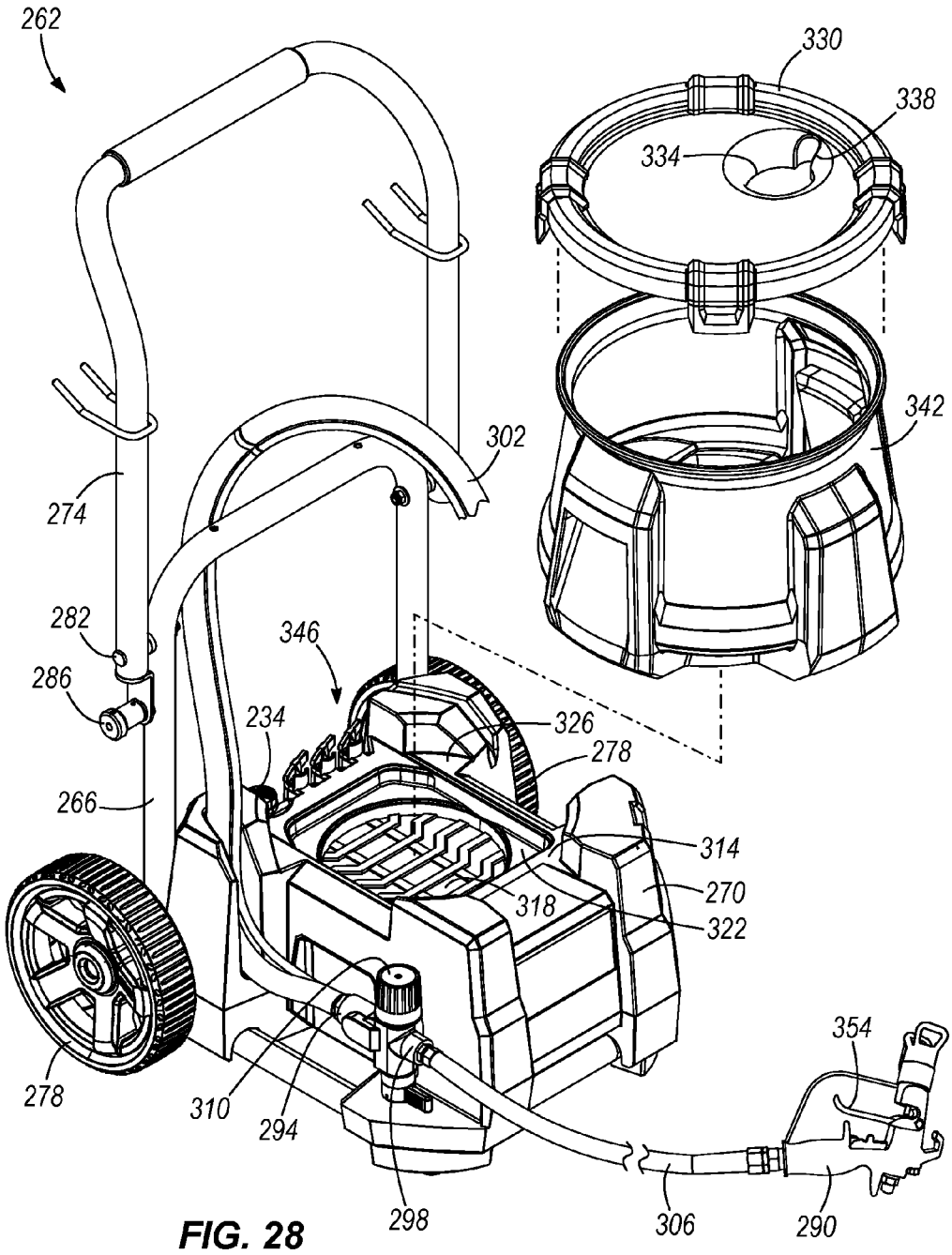
FIG. 28 is a front perspective view of the paint sprayer of FIG. 21, illustrating a spray gun coupled to the paint sprayer by a high-pressure paint hose.

In a manner similar to the paint sprayer 10 of FIGS. 1-19, the pump/motor assembly of the paint sprayer 262 draws paint from the paint container, pressurizes the paint, and discharges the pressurized paint toward a spray gun 290 (FIG. 28). The pump/motor assembly includes an electric motor (e.g., an AC electric motor) electrically connectable to a source of power (e.g., household line current) via a cord. Alternatively, the paint sprayer 262 may include an on-board power source (e.g., a battery), and the electric motor may be configured as a DC electric motor to receive power from the battery. The pump/motor assembly also includes an axial piston pump similar to the pump 54 of the pump/motor assembly 18. As such, the axial piston pump of the pump/motor assembly in the paint sprayer 262 will not be discussed in detail.

With continued reference to FIG. 28, the pump includes an inlet 294 through which paint is drawn from the paint container and an outlet 298 through which the pressurized paint is discharged. A suction tube 302 fluidly connects the pump inlet 294 and the paint container, while a high-pressure hose 306 fluidly connects the pump outlet 298 and the spray gun 290 (described in more detail below). The paint sprayer 262 may include an inlet check valve 70, similar to the inlet check valve shown in FIG. 13, positioned in the pump inlet 294 to facilitate priming the pump when the paint sprayer 262 is initially turned on. The paint sprayer 262 may also include a priming valve, similar to the priming valve 110 described above in the paint sprayer 10, positioned between the pump inlet 294 and the pump outlet 298 to control pump priming.

The paint sprayer 262 includes a valve (not shown) positioned between the inlet 294 and the outlet 298 that is operable to regulate the pressure and/or the flow rate of the pressurized paint discharged by the pump to the spray gun 290. As shown in FIG. 28, the paint sprayer 262 also includes an actuator 310 (e.g., a dial) operably coupled to the regulating valve to adjust the pressure and/or flow rate of the pressurized paint discharged through the pump outlet 298. More particularly, a user of the paint sprayer 262 rotates the dial 310 in a first direction to increase the flow rate of the pressurized paint that is delivered to the spray gun 290, and a second direction to decrease the flow rate of the pressurized paint that is delivered to the spray gun 290.

With continued reference to FIG. 28, the housing 270 of the pump/motor assembly includes a platform 314 upon which the paint container is supported. The platform 314 includes a plurality of support surfaces 318, 322, 326 upon which differently-sized paint containers may be supported. More particularly, the platform 314 includes respective support surfaces 318, 322, 326 for one-gallon round paint containers, one-gallon square paint containers, and 5-gallon paint containers. In the illustrated construction, each of the support surfaces 318, 322, 326 is oriented substantially parallel with the ground, such that the paint containers are supported substantially vertically on the platform 314. In a further construction, each of the support surfaces 318, 322, 326 may be configured to support the paint container at an incline or at an oblique angle (e.g., 5 degrees or less) with respect to the ground, in a similar manner as the inclined second support surface 218 on the paint sprayer 10. As another alternative, the platform 314 of the paint sprayer 262 may include a plurality of inclined support surfaces for the different sized paint containers in addition to the illustrated support surfaces 318, 322, 326.

With continued reference to FIG. 28, the paint sprayer includes a lid 330 sized to attach to a paint container (e.g., a 5-gallon paint container). The lid 330 includes an aperture 334 through which the suction tube 302 is received. The lid 330 also includes a retainer 338 integrally formed with the lid 330 adjacent the aperture 334. Specifically, the retainer 338 is configured having a C-shaped cross-section, and is sized to provide a snap-fit with the suction tube 302 to secure the suction tube 302 to the lid 330 and the paint container (FIG. 28). As such, the suction tube 302 may be retained and secured to the lid 330 such that the inlet of the suction tube 302 is maintained near the bottom of the paint container. Alternatively, the retainer 338 may have any of a number of different configurations to secure the suction tube 302 to the lid 330 and maintain the inlet of the suction tube 302 near the bottom of the paint container to draw or suction substantially all of the paint from the paint container.

The paint sprayer 262 also includes an enclosure 342 that is optionally coupled between the platform 314 and the lid 330. In the illustrated construction of the paint sprayer 262, a snap-fit is utilized between the lid 330 and the enclosure 342 to secure the lid 330 to the enclosure 342, while the enclosure 342 merely sits on the platform 314 without being positively secured. Alternatively, the lid 330 may be secured to the enclosure 342 in any of a number of different ways, and the enclosure 342 may be positively secured to the platform 314. The enclosure 342 is used with the paint sprayer 262 when, for example, a one-gallon paint container is supported on the platform 314 to adapt the lid 330 for use with the one-gallon paint container. When used together, the enclosure 342 and lid 330 reduce the amount of spilled paint or splatter from the paint container that might otherwise reach the surroundings of the paint sprayer 262.

Figure 29:
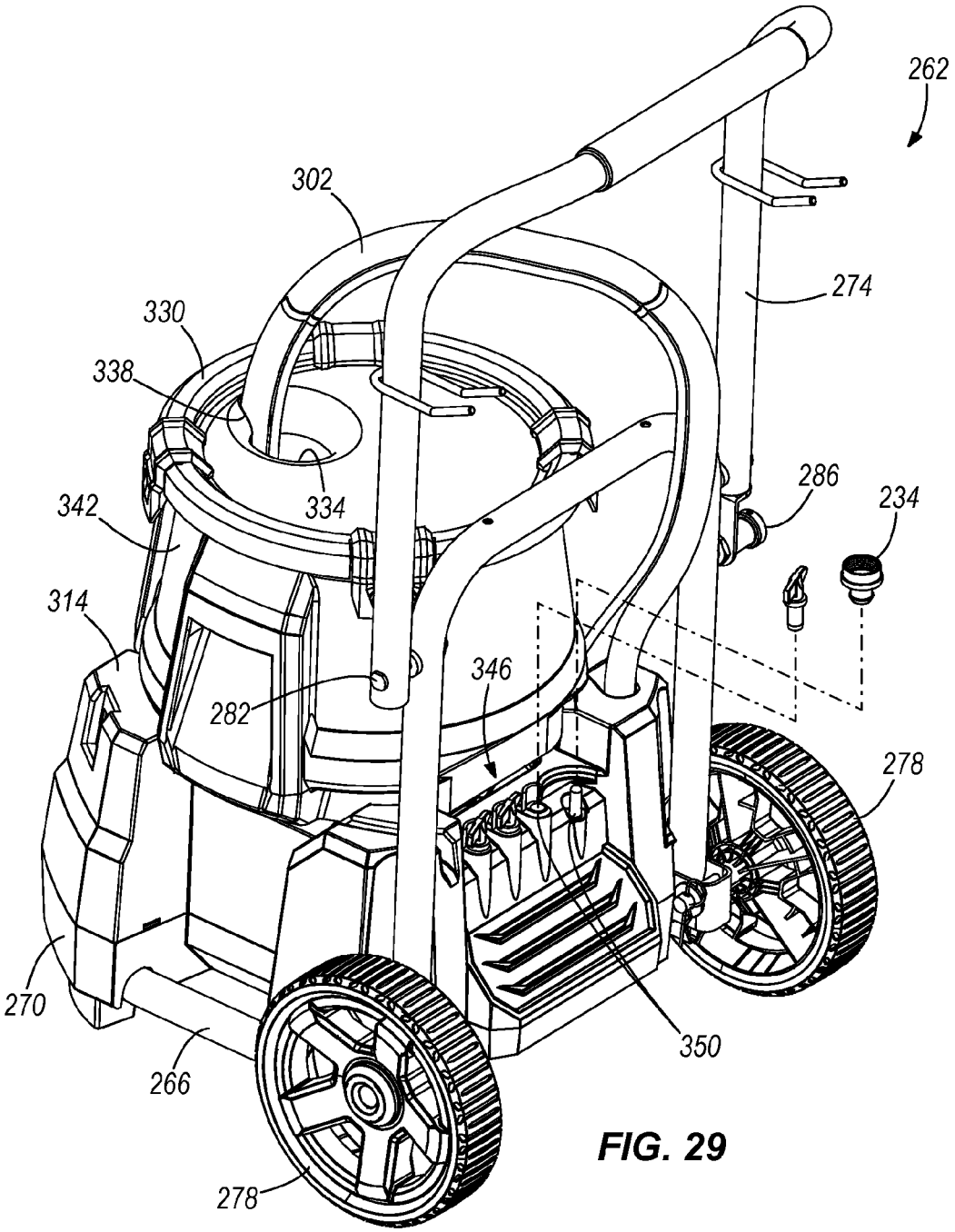
FIG. 29 is an enlarged, rear perspective view of the paint sprayer of FIG. 28, illustrating an on-board accessory storage tray.

With reference to FIG. 29, the paint sprayer 262 includes a storage compartment 346 coupled to the housing 270 having receptacles 350 in which to receive accessories for the paint sprayer 262 (e.g., the garden hose adapter 234 of FIG. 17, etc.). Specifically, the storage compartment 346 is integrally formed with the housing 270 as a single piece from a plastic material (e.g., using a blow-molding or injection-molding process, etc.).

Figure 30:
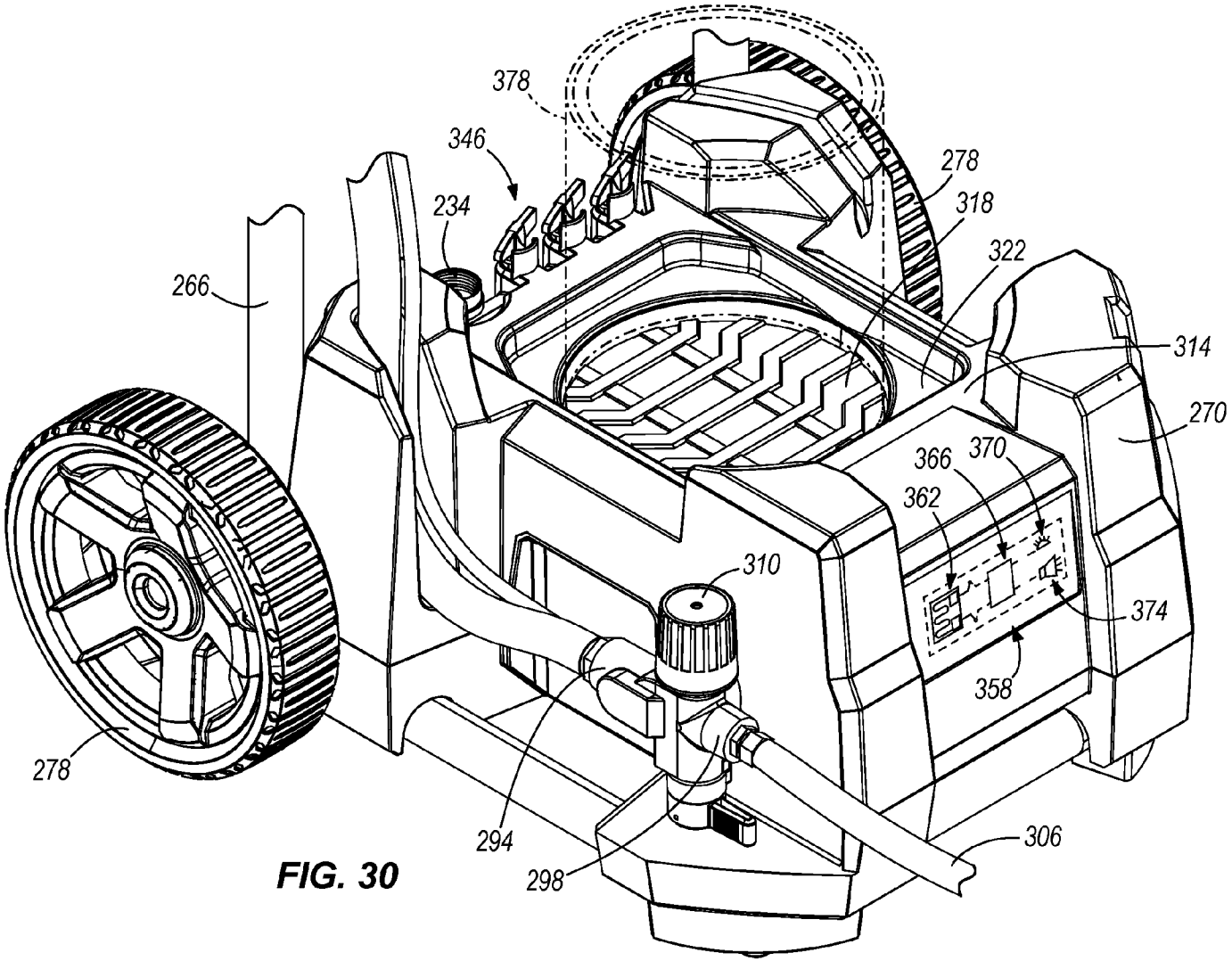
FIG. 30 is an enlarged, front perspective view of the paint sprayer of FIG. 28, illustrating a paint level indicator on the platform of the paint sprayer.

With reference to FIG. 30, the paint sprayer 262 includes a paint level indicator 358 coupled to the platform 314. The paint level indicator 358 includes a strain gauge 362 positioned beneath one or more of the support surfaces 318, 322, 326 of the platform 314, an electrical circuit 366 in electrical communication with the strain gauge 362, and one of a visual indicator 370 (e.g., an LED indicator) and an aural indicator 374 (e.g., a buzzer) in electrical communication with the circuit 366. In operation of the paint level indicator 358, the strain gauge 362 outputs an electrical signal to the circuit 366 that is proportional to the weight of a container 378 supported on one or more of the support surfaces 318, 322, 326 and its contents (i.e., paint). The electrical circuit 366, in turn, is operable to trigger either or both of the visual indicator 370 and the aural indicator 374 when the level of paint in the container 378 becomes low. Alternatively, other components may be employed with the paint level indicator 358 to determine the amount of paint remaining in the container 378 when the sprayer 262 is in use (e.g., one or more microswitches employed with a movable support surface).

To use the paint sprayer 262, a user first secures the lid 330 directly to the open end of the paint container (if using a 5-gallon paint container), and then positions the container on the support surface 326 of the platform 314. Alternatively, if a one-gallon paint container is being used, the user would position the paint container on one of the support surfaces 318, 322 of the platform 314, position the enclosure 342 on top of the platform 314, and then attach the lid 330 to the open end of the enclosure 342. After the paint container is placed, the user inserts the inlet of the suction tube 302 through the aperture 334 in the lid 330 and positions the inlet of the suction tube 302 near the bottom of the paint container. Optionally, the user may insert the suction tube 302 into the retainer 338 in the lid 330 to secure the suction tube 302 with respect to the lid 330 and maintain the position of the inlet of the suction tube 302 near the bottom of the paint container.

Then, the user of the paint sprayer 262 connects one end of the high-pressure paint hose 306 to the pump outlet 298 and the other end to the spray gun 290. Before using the paint sprayer 262 to paint any surfaces or workpieces, however, the user should initially prime the pump in a similar manner as described above for the paint sprayer 10 of FIGS. 1-19. After the pump is sufficiently primed, the user of the paint sprayer 262 manually actuates the priming valve to initiate delivery of the pressurized paint through the pump outlet 298 to the spray gun 290. The user may then depresses a trigger 354 on the spray gun 290 to begin spraying the pressurized paint (FIG. 28).

At any time during use of the paint sprayer 262, the user may adjust the regulating valve to change the amount of paint that is ultimately discharged from the spray gun 290. More particularly, the user adjusts the dial 310 to increase or decrease the flow rate of the pressurized paint from the pump outlet 298, and therefore the pressure of the pressurized paint in the high-pressure paint hose 306.

When the user is finished using the paint sprayer 262, the user removes the suction tube 302 from the paint container and flushes the pump, the high-pressure paint hose 306, and the spray gun 290 with water using the garden hose adapter 234 described above and shown in FIGS. 17 and 18. After the paint sprayer 262 has been cleaned, the user may fold or retract the handle 274 to the storage position to enhance the compactness of the paint sprayer 262 for storage.

Although the invention has been described in detail with reference to certain preferred embodiments, variations and modifications exist within the scope and spirit of one or more independent aspects of the invention as described.

Various features of the invention are set forth in the following claims.

What is claimed is:

1. A paint sprayer comprising:

a frame;

a motor supported by the frame;

a pump operably coupled to the motor to draw paint from a paint source and pressurize the paint;

a blower supported by the frame and operable to discharge pressurized air into the pressurized paint discharged by the pump;

a platform coupled to the frame, wherein the platform includes a support surface on which a paint-carrying container is supported; and a control panel coupled to the frame, wherein the control panel faces away from the platform, wherein at least one of the pump and the blower includes an outlet extending through the control panel and accessible from a side of the control panel facing away from the platform.

2. The paint sprayer of claim 1, further comprising a valve positioned downstream of the pump, wherein the valve is operable to regulate at least one of the pressure and the flow rate of the pressurized paint discharged by the pump.

3. The paint sprayer of claim 1, further comprising an inlet check valve positioned upstream of the pump, wherein the inlet check valve includes a seat, a sealing member selectively positioned against the seat to block fluid flow past the seat, and a biasing member biasing the sealing member against the seat.

4. The paint sprayer of claim 3, wherein the sealing member is a ball, and wherein the biasing member is a compression spring biasing the ball against the seat.

5. The paint sprayer of claim 1, further comprising a plurality of receptacles supported by the frame in which to receive a plurality of accessories for the paint sprayer.

6. The paint sprayer of claim 5, wherein the receptacles are defined in a storage compartment coupled to the frame.

7. The paint sprayer of claim 6, wherein the frame includes a plurality of tubular members, and wherein the storage compartment is strapped to the tubular members of the frame.

8. The paint sprayer of claim 1, wherein the support surface is a first support surface, wherein the platform further includes a second support surface inclined at an oblique angle with respect to the first support surface, and wherein the paint-carrying container is supportable on one of the first support surface and the second support surface.

9. The paint sprayer of claim 8, wherein the second support surface is inclined at an angle of about 5 degrees or less with respect to the first support surface.

10. The paint sprayer of claim 1, wherein the pump includes an outlet extending through the control panel, and wherein the blower includes an outlet extending through the control panel.

11. The paint sprayer of claim 10, further comprising:

a paint gun having at least one of an orifice and a nozzle through which to discharge the pressurized paint;

a first hose fluidly connecting the paint gun and the pump outlet; and a second hose fluidly connecting the paint gun and the blower outlet.

12. The paint sprayer of claim 11, wherein the paint gun includes a first inlet in fluid communication with the first hose, and a second inlet in fluid communication with the second hose, and wherein the pressurized air carried in the second hose is discharged into the pressurized paint carried in the first hose after the pressurized paint is discharged through the one of the orifice and the nozzle in the paint gun.

13. The paint sprayer of claim 1, further comprising a paint level indicator coupled to the platform.

14. The paint sprayer of claim 13, wherein the paint level indicator includes a strain gauge configured to output an electrical signal proportional to the weight of the paint-carrying container and its contents.

15. The paint sprayer of claim 14, wherein the paint level indicator includes a circuit in electrical communication with the strain gauge, at least one of a visual indicator and an aural indicator in electrical communication with the circuit.

16. The paint sprayer of claim 1, further comprising a handle pivotably coupled to the frame, wherein the handle is pivotable between an extended position and a retracted position for storage.

17. The paint sprayer of claim 1, further comprising:

a suction hose fluidly communicating the paint source and the pump, the suction hose including a first end coupled to an inlet of the pump and a second end disposed in the paint source; and an adapter having a first end that is one of received within the second end of the suction hose and inserted over the second end of the suction hose, and a second end having a threaded portion for coupling to a garden hose.

18. The paint sprayer of claim 17, wherein the first end of the adapter includes a nipple that is received within the second end of the suction hose, and wherein water from the garden hose is introduced into the pump via the adapter and the suction hose to clean the pump.

19. The paint sprayer of claim 1, wherein the motor is a first motor, and wherein the blower includes a second motor and a fan operably coupled to the second motor.

20. The paint sprayer of claim 19, wherein the second motor is separately operable from the first motor.

21. A paint sprayer comprising:

a frame;

a motor supported by the frame;

a pump operably coupled to the motor to draw paint from a paint source and pressurize the paint;

a blower supported by the frame and operable to discharge pressurized air into the pressurized paint discharged by the pump;

a platform coupled to the frame, wherein the platform includes a support surface on which a paint-carrying container is supported, wherein the bottom of the paint-carrying container is supported by the platform, and wherein the side of the paint-carrying container is at least partially supported by at least one of the pump and the motor during transport of the paint sprayer; and a housing containing the pump and the motor, and wherein the side of the paint-carrying container is at least partially supported by the housing during transport of the paint sprayer.

22. A paint sprayer comprising:

a frame;

a motor supported by the frame;

a pump operably coupled to the motor to draw paint from a paint source and pressurize the paint; and a blower supported by the frame and operable to discharge pressurized air into the pressurized paint discharged by the pump, wherein the paint sprayer is operable in an airless mode, in which the blower is not utilized to discharge pressurized air into the pressurized paint discharged by the pump, and an air-assisted airless mode, in which the blower is utilized to discharge pressurized air into the pressurized paint discharged by the pump.

23. The paint sprayer of claim 22, further comprising a valve positioned downstream of the pump, wherein the valve is operable to regulate at least one of the pressure and the flow rate of the pressurized paint discharged by the pump.

24. The paint sprayer of claim 22, further comprising an inlet check valve positioned upstream of the pump, wherein the inlet check valve includes a seat, a sealing member selectively positioned against the seat to block fluid flow past the seat, and a biasing member biasing the sealing member against the seat.

25. The paint sprayer of claim 22, further comprising a plurality of receptacles supported by the frame in which to receive a plurality of accessories for the paint sprayer.

26. The paint sprayer of claim 22, further comprising a platform coupled to the frame, wherein the platform includes a support surface on which a paint-carrying container is supported.

27. The paint sprayer of claim 26, wherein the support surface is a first support surface, wherein the platform further includes a second support surface inclined at an oblique angle with respect to the first support surface, and wherein the paint-carrying container is supportable on one of the first support surface and the second support surface.

28. The paint sprayer of claim 22, further comprising a handle pivotably coupled to the frame, wherein the handle is pivotable between an extended position and a retracted position for storage.

29. The paint sprayer of claim 22, further comprising:

a suction hose fluidly communicating the paint source and the pump, the suction hose including a first end coupled to an inlet of the pump and a second end disposed in the paint source; and an adapter having a first end that is one of received within the second end of the suction hose and inserted over the second end of the suction hose, and a second end having a threaded portion for coupling to a garden hose.

30. The paint sprayer of claim 22, wherein the motor is a first motor, and wherein the blower includes a second motor and a fan operably coupled to the second motor.

* * * * *